US012577854B2

(12) United States Patent
Haukelidsæter Eidesen

(10) Patent No.: US 12,577,854 B2
(45) Date of Patent: Mar. 17, 2026

(54) SYSTEM AND METHOD FOR CONTROLLING THE PRESSURE OF FLUID IN A SUBTERRANEAN VOID

(71) Applicant: HORISONT ENERGI AS, Sandnes (NO)

(72) Inventor: Bjørgulf Haukelidsæter Eidesen, Stavanger (NO)

(73) Assignee: HORISONT ENERGI AS (NO)

( * ) Notice: Subject to any disclaimer, the term of this patent is extended or adjusted under 35 U.S.C. 154(b) by 0 days.

(21) Appl. No.: 18/699,759

(22) PCT Filed: Oct. 18, 2022

(86) PCT No.: PCT/EP2022/078995
§ 371 (c)(1),
(2) Date: Apr. 9, 2024

(87) PCT Pub. No.: WO2023/066946
PCT Pub. Date: Apr. 27, 2023

(65) Prior Publication Data

US 2025/0237121 A1 Jul. 24, 2025

(30) Foreign Application Priority Data

Oct. 18, 2021 (EP) ..... 21203096

(51) Int. Cl.
*E21B 41/00* (2006.01)
*E21B 47/06* (2012.01)
*E21B 47/07* (2012.01)

(52) U.S. Cl.
CPC ..... *E21B 41/0007* (2013.01); *E21B 41/0064* (2013.01); *E21B 47/07* (2020.05)

(58) Field of Classification Search
CPC ..... E21B 41/0007; E21B 41/0057; E21B 41/0064; E21B 47/06; E21B 47/07
See application file for complete search history.

(56) References Cited

U.S. PATENT DOCUMENTS 8,524,152 B2 9/2013 Kelemen et al.
8,783,364 B2 7/2014 Ikegawa
(Continued)

FOREIGN PATENT DOCUMENTS

CN 102465715 B 3/2015
EP 4053009 A1 3/2021
(Continued)

OTHER PUBLICATIONS

Shi, Ji-Quan et al., Snøhvit CO2 storage project: Assessment of CO2 injection performance through history matching of the injection well pressure over a 32-months period, Energy Procedia 37, 2013, pp. 3267-3274.
(Continued)

*Primary Examiner* — Matthew R Buck
(74) *Attorney, Agent, or Firm* — Dilworth IP, LLC

(57) ABSTRACT

A fluid handling system, method, and computer-readable storage medium are presented for controlling the flow and injection pressure of fluid injected into a subterranean void at an offshore injection site for long term storage. A subsea template receives fluid from a fluid storage arranged on a seabed in connection with at least two well heads for at least two drill holes to the void. For each drill hole, a first pressure gauge at the bottom opening of the drill hole measures a bottom pressure, $P_B$. The template comprises a utility system causing received fluid to be injected into the void and includes a valve system with a choke valve for each drill hole to control the injection of fluid into the void in response to control commands ($C_{cmd}$) based on a pre-set desired flow rate for each drill hole and a pre-set lowest allowable flow rate from the fluid storage.

25 Claims, 4 Drawing Sheets

(56) References Cited

U.S. PATENT DOCUMENTS

| | | | | |
|---|---|---|---|---|
| 2008/0319726 | A1* | 12/2008 | Berge | E21B 41/0064 703/10 |
| 2013/0259575 | A1 | 10/2013 | Hoeier et al. | |
| 2023/0323755 | A1* | 10/2023 | Al-Qasim | E21B 43/164 166/402 |

FOREIGN PATENT DOCUMENTS

| | | | | |
|---|---|---|---|---|
| EP | 3995667 | A1 | 5/2022 | |
| NO | 20030990 | L | 9/2004 | |
| WO | 2010109340 | A2 | 9/2010 | |
| WO | WO-2023175364 | A1 * | 9/2023 | E21B 41/0064 |
| WO | WO-2023194765 | A1 * | 10/2023 | F17C 3/005 |

OTHER PUBLICATIONS

Eiken Ola et al., Lessons Learned from 14 years of CCS Operations: Sleipner, In Salah and Snøhvit, Energy Porcedia 4, 2011, pp. 5541-5548.

Benson Sally et al., Underground geological storage, IPCC Special Report on Carbon dioxide Capture and Storage, Chapter 5, pp. 195-276.

* cited by examiner

SYSTEM AND METHOD FOR CONTROLLING THE PRESSURE OF FLUID IN A SUBTERRANEAN VOID

TECHNICAL FIELD

The present invention relates generally to strategies for reducing the amount of environmentally unfriendly gaseous components in the atmosphere. Especially, the invention relates to injecting fluid for long term storage in a subterranean void and controlling the pressure in the subterranean void during such injection to avoid damaging the subterranean formations.

BACKGROUND

Carbon dioxide is an important heat-trapping gas, a so-called greenhouse gas, which is released through certain human activities such as deforestation and burning fossil fuels. However, also natural processes, such as respiration and volcanic eruptions generate carbon dioxide.

Today's rapidly increasing concentration of carbon dioxide, $CO_2$, in the Earth's atmosphere is problem that cannot be ignored. Over the last 20 years, the average concentration of carbon dioxide in the atmosphere has increased by 11 percent; and since the beginning of the Industrial Age, the increase is 47 percent. This is more than what had happened naturally over a 20000-year period—from the Last Glacial Maximum to 1850.

Various technologies exist to reduce the amount of carbon dioxide produced by human activities, such as renewable energy production. There are also technical solutions for capturing carbon dioxide from the atmosphere and storing it on a long term/permanent basis in subterranean reservoirs.

For practical reasons, most of these reservoirs are located under mainland areas, for example in the U.S.A and in Algeria, where the In Salah CCS (carbon dioxide capture and storage system) was located. However, there are also a few examples of offshore injection sites, represented by the Sleipner and Snøhvit sites in the North Sea. At the Sleipner site, $CO_2$ is injected from a bottom fixed platform. At the Snøhvit site, $CO_2$ from LNG (Liquefied natural gas) production is transported through a 153 km long 8-inch pipeline on the seabed and is injected from a subsea template into the subsurface below a water bearing reservoir zone as described inter alia in Shi, J-Q, et al., "Snøhvit $CO_2$ storage project: Assessment of $CO_2$ injection performance through history matching of the injection well pressure over a 32-months period", Energy Procedia 37 (2013) 3267-3274. The article, Eiken, O., et al., "Lessons Learned from 14 years of CCS Operations: Sleipner, In Salah and Snøhvit", Energy Procedia 4 (2011) 5541-5548 gives an overview of the experience gained from three $CO_2$ injection sites: Sleipner (14 years of injection), In Salah (6 years of injection) and Snøhvit (2 years of injection).

The Snøhvit site is characterized by having the utilities for the subsea $CO_2$ wells and template onshore. This means that for example the chemicals, the hydraulic fluid, the power source and all the controls and safety systems are located remote from the place where $CO_2$ is injected. This may be convenient in many ways. However, the utilities and power must be transported to the seabed location via long pipelines and high voltage power cables, respectively. The communications for the control and safety systems are provided through a fibre-optic cable. The $CO_2$ gas is pressurized onshore and transported through a pipeline directly to a well head in a subsea template on the seabed, and then fed further down the well into the reservoir. This renders the system design highly inflexible because it is very costly to relocate the injection point should the original site fail for some reason. In fact, this is what happened at the Snøhvit site, where there was an unexpected pressure build up, and a new well had to be established.

As is understood in the art, it is vital to control the pressure during injection into a subterranean reservoir to avoid damage to the reservoir, such as destruction of reservoir formations due to over pressurization caused by blockage by $CO_2$ hydrates forming close to the well area, or mineralisation of $CO_2$ in the same area.

The related art document CN102465715 B discloses a management system for geological storage of carbon dioxide. The system comprises storage tanks, pipes, flow pressure control unit, distribution chamber portion and underground tubular well. A pressure detection system detects the flow pressure of carbon dioxide to be supplied from the plurality of storage tanks. On the basis of flow pressure, valves are opened or closed. A temperature adjustment unit is used for detecting the temperature of carbon dioxide and adjust the temperature to a desired value.

The IPCC Special Report on Carbon dioxide Capture and Storage, Chapter 5: Underground geological storage, pages 195-276, by Sally Benson et. al., discusses geological storage of $CO_2$ and a method of monitoring and controlling the pressure of $CO_2$ to be injected in an injection well. A central control room is used to collect data from pressure gauges. Measurements are made either at the injection well head or near distribution manifolds. The pressure gauges are connected to shut-off valves that stop or curtail injection if the pressure exceeds a predetermined safe threshold or if there is a drop in pressure as a result of a leak.

Thus, solutions are known for controlling the pressure of fluid to be injected into a subterranean reservoir. However, there exists a need for a novel solution for achieving pressure and/or temperature control to avoid damage to the reservoir.

SUMMARY

The existing solutions described above relate to detecting and controlling the pressure of fluid to be injected into a subterranean reservoir, at the storage tanks, at the injection well head or near distribution manifolds. In other words, the existing solutions relate to detecting and controlling the pressure of the fluid before it enters the well, is passed through the well and enters into the subterranean reservoir. Although controlling the pressure of the fluid before it enters the well is relevant for the purpose of controlling the injection flow, it does not provide information on the actual pressure in the reservoir and how to control this pressure to protect the integrity of the reservoir. The reason is that the reservoir is located at a much lower subsea level, typically 800 meters below the surface of the sea or deeper, and hence is under a much higher pressure than the other system components. In an example, an event damaging the reservoir formation could cause the pressure at the well head to drop, causing a control system that only controls the pressure of the fluid before it enters the well to increase the pressure, which in turn would damage the reservoir formation even more.

As mentioned above, there hence exists a need for a novel solution for achieving pressure and/or temperature control to avoid damage to the reservoir. In advanced $CO_2$ injection systems that are fully automated, there is a need to include control logic that protects the reservoir against over pressurization and corresponding damaging of the reservoir. Reservoirs include various dynamics that need more complex control logics and systems for its protection.

The inventors have realized that in order to avoid over-pressurization of the subterranean reservoir, and any damage that this may lead to, it is crucial to obtain reliable measurements and/or estimations of the pressure in the bottom of the well, i.e., at entry into the reservoir, and in the reservoir, and further to control the fluid injection based on these measurements and/or estimations. The object of the present invention is therefore to offer a solution for controlling the pressure and/or flow (i.e., to reduce flow in the event of over pressurization) during injection of a fluid into a subterranean reservoir, the part of the subterranean reservoir into which the fluid is injected hereinafter also referred to as a subterranean void.

According to one aspect of the invention, the object is achieved by a system for controlling the pressure during injection of a fluid into a subterranean void the flow and injection pressure of fluid to be injected into a subterranean void at an offshore injection site for long term storage. The fluid handling system comprises a subsea template arranged on a seabed in connection with at least two well heads for a respective at least two drill holes to a subterranean void.

Each drill hole has a top opening operatively connected to the respective well head and a bottom opening at or near the bottom of the drill hole, or well, the bottom opening being arranged to pass fluid into the subterranean void. The bottom opening may be a single opening or consist of a plurality of smaller openings, e.g., perforations, arranged to pass fluid into the subterranean void. The subsea template is configured to receive fluid from a fluid storage or pipeline and to pass it into the drill hole. Hereinafter, the drill hole may also be referred to as a well. The subsea template is in fluid connection with each of the well heads of the at least two drill holes via a respective separate conduit or via a distribution manifold. The subsea template comprises a utility system configured to cause received fluid to be injected into the subterranean void via the at least two drill holes. In other words, the utility system is not located onshore, which is advantageous for logistic reasons. The utility system in turn comprises a valve system, for example in the form of a valve tree, which is configured to forward the received fluid to at least two drill holes, or wells. Further, the valve system is configured to be remote controllable in response to control commands that may be received via a communication interface. Thereby, a minimal number of onsite staffing is required on the vessel that offloads the fluid. The valve system has at least one choke valve on each of the at least two wells configured to control the injection of fluid into the subterranean void in response to received control commands.

The fluid handling system further comprises, for each of the at least two drill holes, a first pressure gauge at the bottom opening of the drill hole or close to the bottom opening of the drill hole, for measuring a bottom pressure of the drill hole. The bottom pressure is hence measured close to the bottom of each drill hole, i.e., at or close to the lower opening in the drill hole/well where fluid exits the well and enters the subterranean reservoir for long time storage. The lower opening may consist of one or more opening, for example including a series of perforations in the drill hole/well for fluid to pass out of the drill hole/well and into the subterranean reservoir for long time storage. The pressure measurements should be as deep as possible, i.e., as close as possible to the perforated area in the well/drill hole from where the fluid enters the reservoir. This is because the phase of the fluid changes along the column (i.e., from the top of the well to the bottom of the well), especially during the start-up of injection at the beginning of the injection process or after a period of no injection.

Any build-up of pressure in the subterranean reservoir above certain bounds, or rapid increases or decreases in pressure, indicates that something is wrong. In an example wherein the fluid is $CO_2$, the problem may be caused by e.g., $CO_2$ hydrates, unknown formations, mineralization of $CO_2$ and/or reduced injectivity, etc. In another example, the pressure rapidly decreases due to damage of the reservoir formation, whereby $CO_2$ suddenly flows into cracks in the reservoir formation. If the pressure is thereafter increased, the cracks would spread, which leads to even further damaging of the reservoir formation. Advantageously, by measuring the bottom pressure it is possible to detect any pressure build-up or pressure decrease in the subterranean reservoir or area surrounding the subterranean reservoir. The bottom pressure will be equal to or close to (depending on the placement of the first pressure gauge within the drill hole/well) the pressure in the subterranean void and therefore a relevant pressure to compare to e.g., a critical or desired pressure value for the surrounding reservoir. Thereby, control of the pressure in the subterranean void to avoid over-pressurization, based on the actual current pressure in the subterranean void, and/or pressure measurements over time to detect any changes with regard to pressure build-up or pressure decrease, is enabled. This cannot be achieved by the prior existing solutions mentioned herein, which only measure the pressure of fluid to be injected, by measurements being performed e.g., at the storage tanks, at the injection well head or near distribution manifolds. In other words, the fluid pressure measurements are in these prior solutions performed before the fluid enters the well, and far from where the fluid enters the subterranean void. As such, they do not represent the pressure in the subterranean reservoir, or a close enough estimation of this pressure. Therefore, using measurements of these prior solutions as basis for controlling the pressure and/or temperature in the subterranean reservoir would be a significantly inferior solution. As mentioned herein, the prior solutions would also fail to detect, and properly respond to, situations where the reservoir is damaged.

The fluid handling system further comprises a control site being communicatively connected to the first pressure gauge of each of the at least two drill holes and to the subsea template. The control site is configured to, for each of the at least two drill holes, check if a measured bottom pressure has been received from the first pressure gauge of the drill hole. If a measured bottom pressure has been received the control site is configured to set the value of the measured bottom pressure as the current bottom pressure of the drill hole.

The control site is further configured to generate control commands configured to cause the at least one choke valve of each drill hole to control the injection of the fluid into the subterranean void via the respective drill hole based on a respective pre-set desired flow rate for each drill hole and a pre-set lowest allowable flow rate. Thereby, the control site is in one or more embodiment configured to generate control commands configured to cause the at least one choke valve at each of the at least two drill holes or wells to control the injection of the fluid into the subterranean void based on a pre-set desired flow rate for the specific drill hole or well. The different wells can each have separate pressures and flow rates, and there could be damages on one well, but not on the others. Suitably, the at least one choke valve at each of the at least one drill hole or well may therefore be individually controlled in this manner. During injection, the system is suitably configured to simultaneously pass fluid into the subterranean void via the two or more drill holes and to control the flow and injection pressure of the fluid in the individual drill holes based both on the properties of the individual drill holes and the formation into which the fluid is to be injected, and also based on the lowest allowed fluid flow from the fluid storage that is set such that the risk of under pressurization and any potential damage that could be caused thereby is reduced, including e.g. $CO_2$ hydrate formations or $CO_2$ mineralization in the risers. Since the embodiments described herein enable using each subsea template for injection of fluid into a subterranean void via at least two drill holes and controlling the injection of fluid individually for each of the at least two drill holes using the valve system described herein, injection of fluid into the subterranean void is advantageously optimized by reducing both the risk over-pressurization and the risk of under pressurization, thereby maintaining the integrity of the drill holes/wells, the integrity of the subterranean void, and at the same time reducing the risk of formation of $CO_2$ hydrates or $CO_2$ mineralization in the fluid conduits of the system. This is enables by the control site being configured to generate the control commands based on both the respective pre-set desired flow rate for each drill hole (140) and the pre-set lowest allowable flow rate.

The control site is configured to perform this check, setting of current bottom pressure (if a measured value has been received) and generation of control commands repeatedly. Thereby, any unwanted and potentially dangerous deviation in pressure is detected and remedied at an early stage, enabling an improved regulation of pressure at injection into and hence also in the subterranean void. One situation where this control is crucial is when the injection process is optimised to be performed at a high injection rate. In the high injection rate scenario, it is again highly advantageous to be able to simultaneously control the at least one choke valve of each of the at least two drill holes, so that the injection flow rate in one drill hole/well can e.g. be reduced quickly if needed, without having to reduce the injection flow rate from the fluid storage under the lowest allowed flow rate and thereby risk problems induced by under pressurization in the injection risers. Alternatively, or additionally, the pressure control can hence be improved by individually controlling more than one choke valve to achieve a faster pressure reduction. In yet another example, the pressure control can hence be improved by individually controlling more than one choke valve to achieve a slower, distributed, pressure reduction within the subterranean void if this is important to further reduce the risk of damaging the reservoir. Many other advantages of the flexible pressure control for different fluid injection scenarios enabled by the embodiments of the present invention are apparent to the skilled person.

The control commands may be configured to cause the at least one choke valve of each drill hole to control the injection of the fluid into the subterranean void via said drill hole such that the bottom pressure of the drill hole does not deviate more than a first pre-set tolerance from the desired bottom pressure value and/or be configured to cause the at least one choke valve of each drill hole to control the injection of the fluid into the subterranean void via said drill hole such that the rate of change of the bottom pressure of the drill hole over time does not exceed a second pre-set tolerance. Increasing or decreasing pressure may in some embodiments require increasing or decreasing flow, whereby a restriction on the derivative of pressure in such embodiments also limits any changes to flowrate.

Suitably, by controlling the injection of the fluid into the subterranean void via each drill hole such that the bottom pressure does not deviate more than a first pre-set tolerance T1 from the desired bottom pressure value the pressure is controlled to be within an allowed range, which greatly reduces the risk of over or under pressurization and any potential damage that could be caused thereby, and/or $CO_2$ hydrate formations or $CO_2$ mineralization going undetected. The first pre-set tolerance, giving the outer boundaries of the pressure interval, may be any suitable value depending on circumstances. The absolute pressure interval varies with permeability in the reservoir, as a highly permeable reservoir can only take very small pressure ranges, a few bars at the most, whilst a low permeable reservoir can take 5-10 barg without any issue. Hence the boundaries of pressure and flow is reservoir dependent. The suitable tolerance may vary depending on factors such as reservoir formations and hence injectivity restrictions, salinity of the water in the drill hole 140 and/or the subterranean void 150 and hence solubility of the fluid in the water, the depth of the well/drill hole 140 and/or the subterranean void 150 and hence local pressure therein, the density and temperature conditions of the fluid to be injected, local permeability of the reservoir surrounding the well/drill hole 140 and hence flow conditions away from the drill hole 140 into the surrounding reservoir, strength of the reservoir formation in the local area around the drill hole 140 and hence acceptance of pressure differentials without compromising the integrity of the reservoir formations (i.e. avoiding fracturing the local reservoir), the geometry of the reservoir zone surrounding the drill hole 140 affecting the flow of fluid from the drill hole 140, and/or composition of the fluid and hence density and certain physical properties, etc.

Furthermore, by controlling the injection of the fluid into the subterranean void such that, for each drill hole, the rate of change of the bottom pressure over time does not exceed a second pre-set tolerance T2 greatly reduces the risk of potential damage to the subterranean void or the surrounding reservoir due to fast pressure changes. The value of the second pre-set tolerance T2 is like the first pre-set tolerance dependent on characteristics of the reservoir and the maximum pressure allowed before there is a risk that the reservoir area around the drill hole/well 140 and/or subterranean void 150 is damaged. In a non-limiting example, T2 may be set to a maximum pressure change of 1 bar/hour. This is applicable to many reservoirs, but as stated herein the characteristics of the reservoir may demand other limitations and T2 values.

Of course, using a combination of the two tolerances T1 and T2 for each drill hole, i.e. controlling the injection of the fluid into the subterranean void such that the bottom pressure does not deviate more than the first pre-set tolerance T1 from the desired bottom pressure value and controlling the injection of the fluid into the subterranean void such that the rate of change of the bottom pressure over time does not exceed the second pre-set tolerance T2, provides even further reduced risk of damage to the subterranean void or the reservoir.

The control commands may further be configured to cause the at least one choke valve of each drill hole to choke back if the current bottom pressure of the drill hole is equal to or exceeds a pre-set maximum pressure value. Thereby, the risk of potential damage to the subterranean void, the reservoir surrounding it, potentially the cap rock very late into the reservoir life, etc., due to over pressurization, is even further reduced. In other words, in such cases the system shall back-off injection.

According to one embodiment of this aspect, the system further comprises a second pressure gauge for each drill hole located at the top opening of the drill hole for measuring a top pressure of the drill hole. According to this embodiment, for each of the at least two drill holes, if a measured current bottom pressure for the drill hole has not been received at the control site, the control site is further configured to, before generating the control commands: receive a measured top pressure for the drill hole from the second pressure gauge; estimate a weight of the fluid column in the well or drill hole based on a volume and density of the fluid column in the well or drill hole; and estimate a current bottom pressure for the drill hole based on the estimated weight of the fluid column and the measured top pressure. The current bottom pressure for the drill hole is then set to the value of the estimated current bottom pressure for the drill hole and used for generating the control commands. Thereby, a back-up/safety solution is provided in the case that a measurement from the first pressure gauge is not received, which makes the pressure control system even more reliable. If for instance the pressure reading from the first pressure gauge of a drill hole is lost, due to malfunction of the first pressure gauge or the signal from the first pressure gauge not reaching the control site, the system will still obtain a valid estimate of the current bottom pressure so that reliable pressure control can be maintained, and damage avoided.

According to a further embodiment of this aspect of the invention, the system further comprises at least one temperature sensor for each drill hole located in the drill hole or well and being configured to measure the temperature of the fluid in the drill hole or well, wherein the control site is configured to receive the measured temperature from the at least one temperature sensor. In these embodiments, the control site may be configured to use received measurements from the at least one temperature sensor for estimating the current bottom pressure of the drill hole, or improving a determined current bottom pressure of the drill hole, by using the additional information on the phase of the fluid in the drill hole or well derived from the temperature measurement(s) in manners known in the art. Alternatively, or additionally, the system further comprises at least one differential pressure sensor for each drill hole configured to measure pressure changes, wherein the control site is configured to receive the measured pressure changes from the at least one differential pressure sensor. The control site may then further be configured to derive the rate of change, R, of the bottom pressure for the drill hole over time based on measurements over time received from the at least one differential pressure sensor, and/or be configured to derive information on changes in density of the fluid comprised within the well or drill hole based on measurements over time received from the at least one differential pressure sensor. Alternatively, or additionally, the system further comprises at least one density meter for each drill hole located in the well or drill hole and being configured to identify a phase change and/or phase transition of the fluid within the well or drill hole, wherein the control site is configured to receive information on a phase change and/or phase transition of the fluid within the well or drill hole, and/or derive information on a phase change and/or phase transition of the fluid within the subterranean void from the at least one density meter. Advantageously, adding density measurements will further improve model predictions and pressure control in the injection system.

According to different embodiments of this aspect of the invention, the control site may be located in the surface vessel, it may be an onshore control site, it may be integrated in the subsea template in the form of a local processor, or it may be distributed over one or more of these alternatives.

According to a second aspect of the invention, the object is achieved by a method for controlling the flow and injection pressure of fluid to be injected into a subterranean void by a fluid handling system at an offshore injection site for long term storage, which fluid handling system comprises a subsea template being arranged on a seabed in connection with at least two well heads for a respective at least two drill holes to a subterranean void, wherein each drill hole has a top opening operatively connected to the respective well head and a bottom opening arranged to pass fluid into the subterranean void, the subsea template comprising a utility system with a valve system, and the system further comprising a first pressure gauge for each drill hole located at the bottom opening of the drill hole or near the bottom opening of the drill hole for measuring a bottom pressure of the drill hole. The method comprises, repeatedly, for each of the at least two drill holes: checking if a measured bottom pressure from the first pressure gauge has been received at a control site communicatively connected to the first pressure gauge and the subsea template; and, if a measured bottom pressure has been received, setting the value of the measured bottom pressure as the current bottom pressure for the drill hole. The method further comprise generating control commands, by the control site. The control commands are configured to cause the at least one choke valve of each drill hole to control the injection of the fluid into the subterranean void via the drill hole based on a respective pre-set desired flow rate for each drill hole and a pre-set lowest allowable flow rate from the fluid storage.

The control commands may be configured to cause the at least one choke valve of each drill hole to control the injection of the fluid into the subterranean void such that the bottom pressure of the drill hole does not deviate more than a first pre-set tolerance from the desired bottom pressure value and/or such that the rate of change of the bottom pressure of the drill hole over time does not exceed a second pre-set tolerance. As described herein, the absolute pressure interval varies with permeability in the reservoir, as a highly permeable reservoir can only take very small pressure ranges, a few bars at the most, whilst a low permeable reservoir can take 5-10 barg without any issue. Hence the boundaries of pressure and flow is reservoir dependent. The method may further comprise generating the control commands ($C_{cmd}$), by the control site (160), such that the control commands ($C_{cmd}$) are configured to cause the at least one choke valve of each drill hole to choke back if the current bottom pressure of the drill hole is equal to or exceeds a pre-set maximum pressure value.

According to different embodiments of this aspect of the invention, for each of the at least one drill holes, if a measured value for the current bottom pressure has not been received, the method may further comprise, before generating the control commands: receiving at the control site a top pressure of the drill hole measured by a second pressure gauge located at the top opening of the drill hole. In this embodiment, the method further comprises estimating, for each drill hole, by the control site, a weight of the fluid column in the drill hole or well based on the volume of and the density of the fluid in the drill hole; estimating a current bottom pressure based on the estimated weight of the fluid column and the received top pressure and setting the value of the estimated current bottom pressure as the current bottom pressure for the drill hole. According to this embodiment of this aspect of the invention, the method may further comprise receiving measurements from at least one of a respective temperature sensor located in each of the drill holes or wells and being configured to measure the temperature of the fluid in the drill hole or well and/or a respective density meter of each drill hole configured to identify a phase change and/or phase transition of the fluid within the drill hole or well, and estimating the current bottom pressure of the drill hole based on the received measurements.

In some embodiments, the method may comprise receiving, for each drill hole, measurements from at least one differential pressure sensor located at or near the choke valve of the drill hole and being configured to measure pressure changes in the fluid to be injected or already present within the drill hole or well, and deriving the rate of change, R, of the bottom pressure in the drill hole over time based on measurements over time received based on the measurement from the at least one differential pressure sensor. Alternatively, or additionally, the method may comprise deriving information on changes in density of the fluid comprised within the well or drill hole based on measurements over time received from the at least one differential pressure sensor in each drill hole.

According to a third aspect of the invention, the object is achieved by a non-transitory computer-readable storage medium storing instructions which, when executed by processing circuitry of the system, cause the system to perform the steps and functions of the method according to any of the appended method claims.

According to one or more embodiments in any aspect of the invention, the fluid may be, or comprise, carbon dioxide.

There will a critical pressure limit that cannot be breached in the area around each well, which is based upon reservoir depth, formation strength and possibly also cap rock strength. This limit is derived by geo-mechanical evaluations of cores, logs, and drilling data (from a drilled well). According to one or more embodiments in any aspect of the invention, the pre-set maximum pressure value, $P_{MAX}$, is defined as a pre-set critical pressure limit, $P_{CRITICAL}$, at which the subterranean void would be at risk of being damaged, minus a pre-set margin, m, wherein: $P_{MAX}=(P_{CRITICAL}-m)$. Suitably, this provides increased safety, since the pre-set margin ensures that pressure control measures presented herein are initiated before the actual critical pressure limit is reached.

Further advantages, beneficial features and applications of the present invention will be apparent from the following description and the dependent claims.

BRIEF DESCRIPTION OF THE DRAWINGS

The invention is now to be explained more closely by means of preferred embodiments, which are disclosed as examples, and with reference to the attached drawings.

Figure 1A:
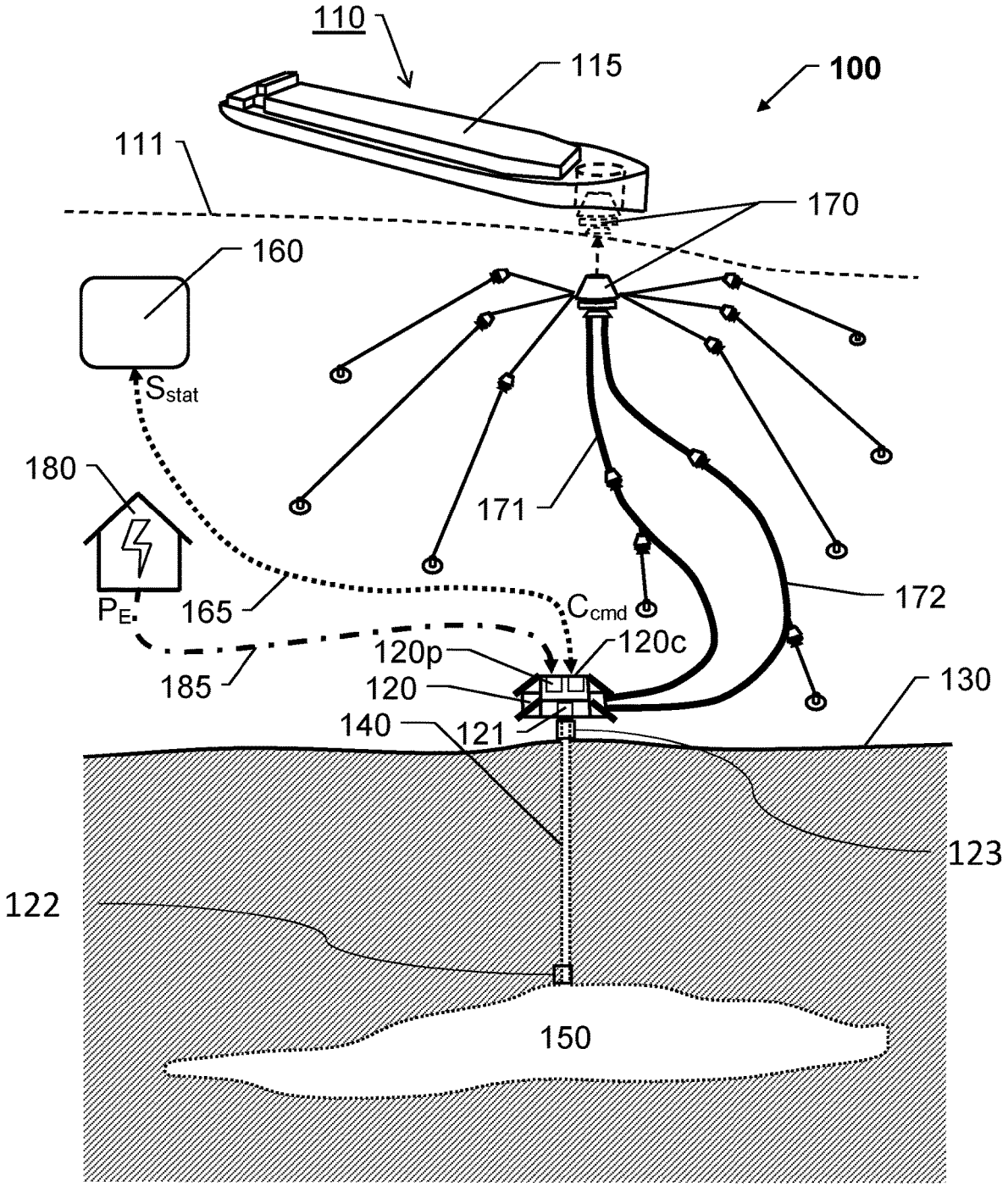
FIG. 1*a* schematically illustrates an arrangement for long term storage of fluids in a subterranean void in which a system according to embodiments of the invention is comprised.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Referring now to injection of $CO_2$, Supercritical carbon dioxide (sCO) is a fluid state of carbon dioxide where it is held at or above its critical temperature and critical pressure. It is important to make sure that the $CO_2$ enters supercritical phase when entering the reservoirs. Preferably, The $CO_2$ should be injected into the reservoir in liquid phase and enter the supercritical phase after having entered the reservoir area, or even some time after entering the reservoir area. This is ensured by injection into reservoirs at 800 meters below the surface of the sea or deeper. Furthermore, a temperature close to 40 degrees Celsius is required. Preferably, the temperature of the fluid is therefore monitored and mitigating measures taken if the temperatures along the well and into the reservoirs zone falls below the required temperature. This is important to avoid gaseous $CO_2$ in the reservoir. In the supercritical phase there are no phase transitions, and the $CO_2$ stays in (supercritical) liquid phase. In order to control this heated Monoethylene Glycol (MEG) or heated MEG mixed with heated water may be injected regularly to maintain the temperature, if required. Typically, in the beginning of the injection (early in the life of the carbon storage), there will also be injection of MEG or water into the subterranean void before it is switched to injection of $CO_2$. Another important feature is to keep the saline water in the reservoir away from the reservoir area surrounding the well while the $CO_2$ is allowed to grow. Salts/minerals in the water can react with $CO_2$ leading to mineralization of $CO_2$—limiting injectivity. Cold temperatures, saline water and $CO_2$ may also lead to $CO_2$ hydrates. Injection of heated MEG will push back the saline water and salts/minerals and add heat to the reservoir zone surrounding the well. This mitigates mineralization, $CO_2$ hydrates and cooling of the reservoir (preventing the entering of supercritical phase). Furthermore, pressure can change in the early period of injection, induced by salt precipitation, relative permeability effects or thermal fracturing. Hence, control of modelling and measurements in the well area is important also for these reasons.

A system according to a first aspect of the invention will first be described in connection with FIGS. 1*a*, 1*b*, 2, 6*a* and 6*b*.

Figure 2:
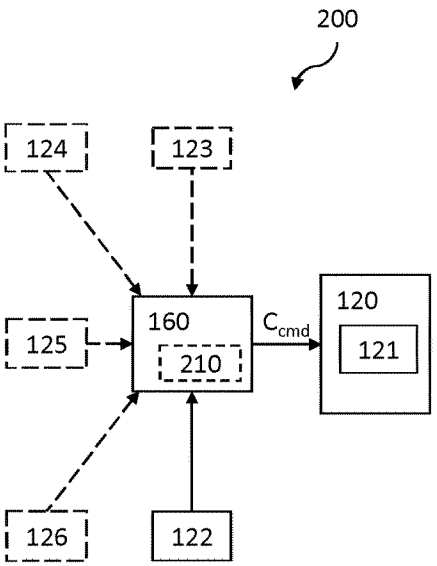
FIG. 2 schematically illustrates a system according to one embodiment of the invention.
Figure 1B:
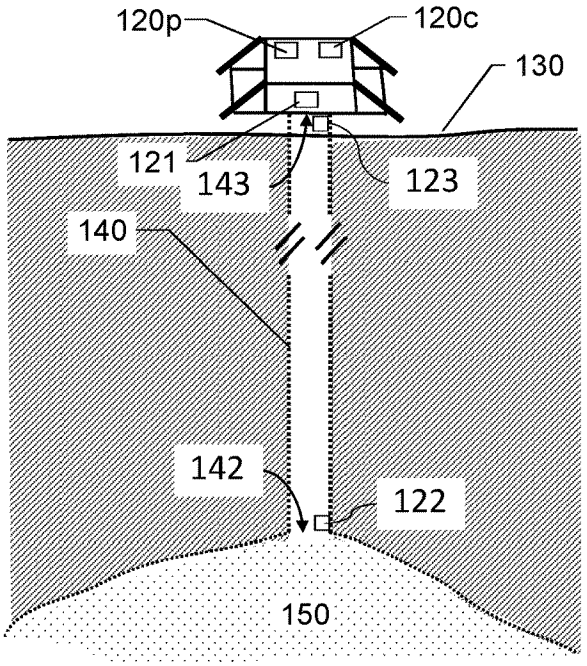
FIG. 1*b* schematically illustrates a system according to one embodiment of the invention.

FIG. 2 schematically illustrates a system 200 for controlling the flow and injection pressure of fluid to be injected into a subterranean void 150 at an offshore injection site 100 for long term storage according to one embodiment of the invention. In FIG. 1*a*, we see an arrangement for long term storage of fluids in a subterranean void, in which a system 200 according to embodiments of the invention is comprised.

The fluid may e.g., contain at least 60 wt. % carbon dioxide. The subterranean void, or accommodation space, is typically a subterranean aquifer. However, according to the invention, the subterranean void 150 may equally well be a reservoir containing gas and/or oil, a depleted gas and/or oil reservoir, a carbon dioxide storage/disposal reservoir, or a combination thereof. These subterranean accommodation spaces are typically located in porous or fractured rock formations, which for example may be sandstones, carbonates, or fractured shales, igneous or metamorphic rocks. Therefore, it is imperial that the pressure of fluids in, and fluids to be introduced into, the subterranean accommodation spaces, is controlled to avoid any damage to the subterranean accommodation spaces.

The fluid storage may comprise a fluid tank of a surface vessel, wherein the subsea template is configured to receive fluid from the fluid storage via at least one injection riser. Alternatively, or additionally, the fluid storage may comprise an onshore fluid storage, wherein the subsea template is configured to receive fluid from the fluid storage via at least one fluid transportation conduit, or wherein the fluid storage is a subsea $CO_2$ fluid storage, wherein the subsea template is configured to receive fluid from the fluid storage via at least one fluid transportation conduit.

Figure 6B:
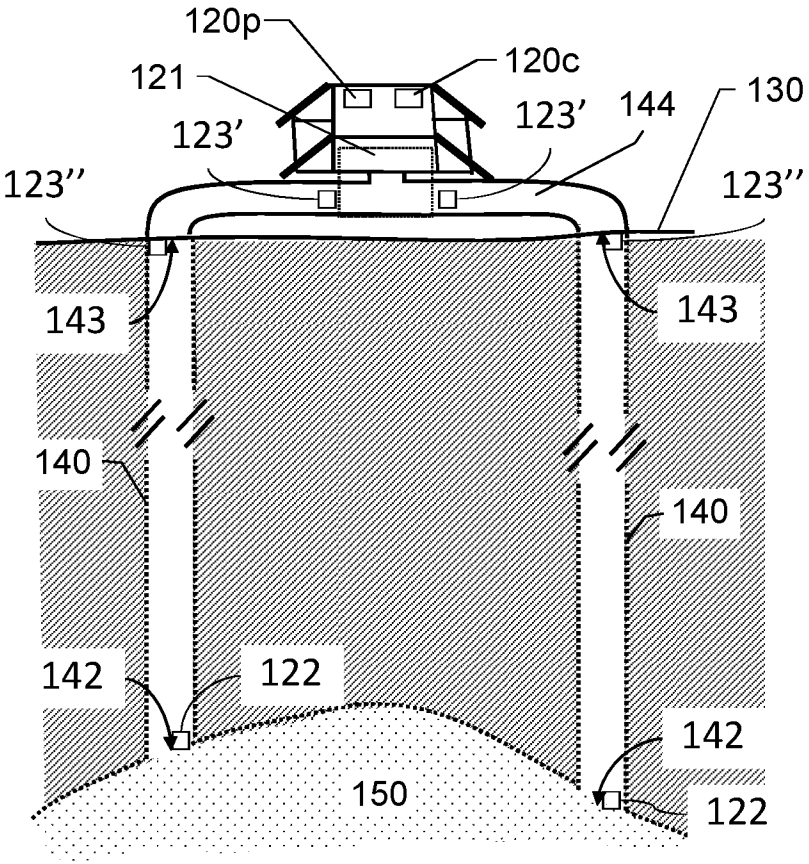
FIG. 6*b* schematically illustrates a system according to one embodiment of the invention.
Figure 6A:
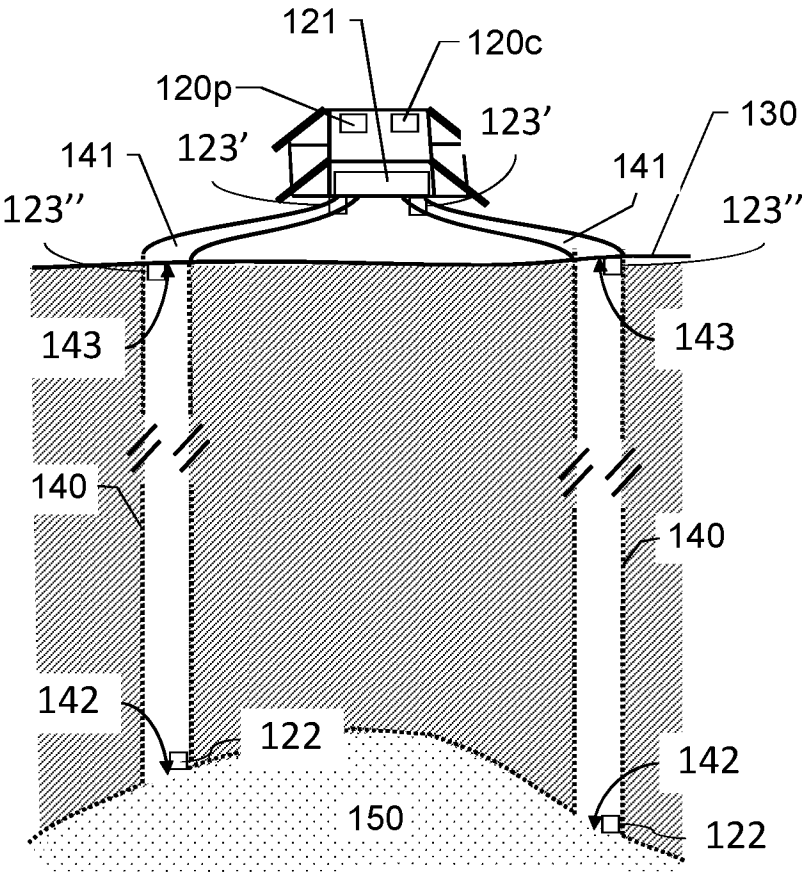
FIG. 6*a* schematically illustrates a system according to one embodiment of the invention.

The system 200 comprises a subsea template 120 arranged on a seabed 130 in connection with at least two well heads for a respective at least two drill holes 140 to the subterranean void 150. Hereinafter, a drill hole 140 may also be referred to as a well. As further shown in the close-up of FIG. 1*b*, each drill hole 140, or well, has a top opening 143 operatively connected to the well head and a bottom opening 142 arranged to pass fluid into the subterranean void 150 from the drill hole, or well. Suitably, at least two drill holes 140 are connected to each subsea template 120. This is illustrated in the examples of FIGS. 6*a* and 6*b*, each showing two drill holes 140 connected to one subsea template 120. FIG. 6*a* shows the subsea template 120 being in fluid connection with each of the well heads of the two drill holes 140 via a respective separate conduit 141, while FIG. 6*b* shows the subsea template 120 being in fluid connection with each of the well heads of the two drill holes 140 via a distribution manifold 144. In the schematic FIGS. 1*b*, 6*a* and 6*b*, the well heads may appear to reside outside the subsea template 120. However, this is purely for illustrational purposes, to enable a better view of the conduits 141 and manifold 144. In reality, the wells are located with their top part, the well head, within the subsea template. In other words, the subsea template completely covers the top and sides of the at least two well heads of the system, down to the seabed, thereby protecting the well heads. The subsea template 120 is configured to receive fluid from a fluid storage and comprises a utility system configured to cause received fluid to be injected into the subterranean void 150. The utility system in turn comprises a valve system 121 with at least one choke valve for each drill hole 140 configured to control the injection of fluid into the subterranean void 150 via the respective drill hole 140 in response to control commands $C_{cmd}$. In other words, the utility system is not located onshore, which is advantageous for logistic reasons. For example, therefore, in contrast to the above-mentioned Snøhvit site, there is no need for any umbilicals or similar kinds of conduits to provide supplies to the utility system. The valve system 121 may be a valve tree.

The system 200 comprises a first pressure gauge 122 for each drill hole 140, located at the bottom opening 142 of the drill hole 140 for measuring a bottom pressure, $P_B$, of the drill hole. Herein, a first pressure gauge 122 being located at the bottom opening 142 of the drill hole 140 is interpreted as the first pressure gauge 122 being located at or very close to (within a predetermined tolerance height above, or possibly below) the bottom opening 142 of the drill hole 140, typically inside the drill hole/well 140. In any of these locations of the first pressure gauge 122, the measured bottom pressure will provide a reliable indicator or estimation of the current pressure in the subterranean void 150. Of course, the closer the first pressure gauge 122 is to the subterranean void 150, the more accurate the measurements will represent the pressure in the subterranean void 150.

The bottom pressure of each drill hole 140 is hence measured close to the bottom of the drill hole 140, i.e., at or close to the lower opening in the drill hole/well where fluid exits the well and enters the subterranean void/reservoir for long time storage. The pressure measurements should be as deep as possible, i.e., as close as possible to the perforated area in the well/drill hole from where the fluid enters the reservoir. This is advantageous because the phase of the fluid changes along the column (i.e., from the top of the well to the bottom of the well), especially during the start-up of injection at the beginning of the injection process or after a period of no injection.

A subsea template 120 may as described herein be in fluid connection with two or more well heads for drill holes 140 to a subterranean void 150. The subsea template 120 is in fluid connection with each of the well heads of the at least two drill holes 140 via a respective separate conduit 141 or via a distribution manifold 144. Two or more well heads for drill holes 140 may also be in fluid connection with more than one subterranean void 150. The fluid connection between the subsea template 120 and the well heads may be enabled via separate conduits or a distribution manifold. If a subsea template 120 is connected to/in fluid connection with more than one well head, i.e., two or more well heads, the valve system 121 in the utility system of that subsea template comprises one choke valve for each well head, being configured to control the injection of fluid via the specific well head into the connected subterranean void 150. Thereby, the injection of fluid into the subterranean void, or voids, 150, via the well heads, can be individually controlled in response to the control commands $C_{cmd}$. If there are several well heads and consequently several drill holes supplying fluid to a single subterranean void 150, the pressure control can hence be even further improved by the individual control of local pressure within the subterranean void 150 by controlling a single choke valve. In another example, the pressure control can hence be improved by individually controlling more than one choke valve to achieve a faster pressure reduction. In yet another example, the pressure control can hence be improved by individually controlling more than one choke valve to achieve a slower, distributed, pressure reduction within the subterranean void 150 if this is important to further reduce the risk of damaging the reservoir.

To simultaneously enable individual control of the flow and injection pressure in each of the at least two drill holes 140, the respective choke valves of the valve system 121 are suitably arranged in or at the top opening of the separate conduits 141, as illustrated schematically in FIG. 6*b*, or downstream of the division of conduits in the distribution manifold 144, as illustrated schematically in FIG. 6*b*.

The pressure and flow, and control of the same, in each drill hole 140 partly depends on the injectivity in the drill hole 140 in question, which may vary as the dynamics may be different in each part of the reservoir formation. For example, injectivity may be excellent in one drill hole 140 and poor in another, due to local formations. Furthermore, for $CO_2$ injection, $CO_2$ hydrates, leading to reduction in the velocity of $CO_2$ injected and an increase of the pressure that will impede the $CO_2$ injection and displacement process, may form in one drill hole 140 and not another. Also for these reasons, it is highly advantageous to have individual control of the injection of fluid into the subterranean void(s) via each well head and connected drill hole 140.

In some embodiments, the system 200 comprise more than one subsea template 120, defined according to any of the embodiments herein.

The system 200 also comprises a control site 160 being communicatively connected to the first pressure gauge 122 of each of the at least two drill holes 140 and the subsea template 120. The control site 160 is configured to repeatedly: check, for each of the at least two drill holes connected to the subsea template 120, if a measured bottom pressure, $P_B$, has been received from the first pressure gauge 122; and, if a measured bottom pressure, $P_B$, has been received, set the value of the measured bottom pressure, $P_B$, as the current bottom pressure, $P_{B_CURRENT}$, for the drill hole 140. The control site 160 is further configured to generate control commands $C_{cmd}$ configured to cause the at least one choke valve of each drill hole 140 to control the injection of the fluid into the subterranean void 150 based on a pre-set desired flow rate for each drill hole 140 and a pre-set lowest allowable flow rate.

The pre-set lowest allowable flow rate may be defined as the lowest allowable flow rate from the fluid storage, i.e. in the conduit leading from the fluid storage to the utility system. In other words, it is the lowest flow rate allowed for the fluid to be injected from the fluid storage via the at least one injection riser 171 and 172 before the fluid conduit is divided into the separate conduits 141, or via the distribution manifold 144. It is set such that the risk of under pressurization and any potential damage that could be caused thereby is reduced.

The control commands $C_{cmd}$ are in some embodiments configured to cause the at least one choke valve of each drill hole 140 to control the injection of the fluid into the subterranean void 150 via the drill hole 140 such that the current bottom pressure $P_{B_CURRENT}$ of the drill hole 140 does not deviate more than a first pre-set tolerance, T1, from the desired bottom pressure value, $P_{DES}$. Thereby, for each drill hole 140, the respective desired bottom pressure value, $P_{DES}$, is compared to the respective current bottom pressure value, $P_{B_CURRENT}$, and the injection pressure can then be controlled, and if needed be adjusted, individually for each of the at least two drill holes 140 connected to the subsea template 120 to increase or reduce the respective bottom pressure to stay close to the desired bottom pressure value, $P_{DES}$.

The first pre-set tolerance T1 may vary for different drill holes 140 and is set based on a selection of factors such as: reservoir formations and hence injectivity restrictions, salinity of the water in the drill hole 140 and/or the subterranean void 150 and hence solubility of the fluid in the water, the depth of the well/drill hole 140 and/or the subterranean void 150 and hence local pressure therein, the density and temperature conditions of the fluid to be injected, local permeability of the reservoir surrounding the well/drill hole 140 and hence flow conditions away from the drill hole 140 into the surrounding reservoir, strength of the reservoir formation in the local area around the drill hole 140 and hence acceptance of pressure differentials without compromising the integrity of the reservoir formations (i.e. avoiding fracturing the local reservoir), the geometry of the reservoir zone surrounding the drill hole 140 affecting the flow of fluid from the drill hole 140, and/or composition of the fluid and hence density and certain physical properties, etc.

Alternatively, or additionally, to controlling the deviation from the desired bottom pressure value, $P_{DES}$, the control commands $C_{cmd}$ may be configured to cause the at least one choke valve of each drill hole 140 to control the injection of the fluid into the subterranean void 150 via the drill hole 140 such that the rate of change, R, of the bottom pressure of the drill hole 140 over time does not exceed a second pre-set tolerance, T2. Thereby, the rate of change of the measured bottom pressure, $P_B$, is compared to the second pre-set tolerance, T2, which is a threshold that is not to be exceeded, and the injection pressure can then be controlled, and if the rate of change is too high the injection pressure, or injection flow, can be adjusted, to increase or reduce the bottom pressure such that the rate of change is reduced. The system 200 may comprise at least one differential pressure sensor 125 for each drill hole 140, typically located at or near the choke valve where pressure is regulated or changes significantly and being configured to measure pressure changes in the fluid to be introduced into or already being present within the well or drill hole 140, wherein the control site 160 is configured to receive the measured pressure changes from the at least one differential pressure sensor 125 of each drill hole 140. In these embodiments, the control site 160 may be configured to derive the rate of change, R, of the bottom pressure for each drill hole 140 over time based on measurements over time received from the respective at least one differential pressure sensor 125. Alternatively, or additionally, the control site 160 may in these embodiments be configured to derive information on changes in density of the fluid comprised within each well or drill hole 140 based on measurements over time received from the respective at least one differential pressure sensor 125. Changes in density may relate to change or transition of phase of the fluid comprised within the well or drill hole 140, as discussed herein.

The control commands $C_{cmd}$ may further be configured to cause the at least one choke valve of each drill hole 140 to choke back, i.e., reduce the flow rate and/or flow pressure, if the current bottom pressure of the drill hole 140 is equal to or exceeds a pre-set maximum pressure value, $P_{MAX}$. By choking back/reducing the flow rate, the pressure build-up/pressure change in the subterranean void is reduced, stopped, or even reversed, and the absolute pressure is stopped from increasing further, or even caused to decrease. Of course, a combination of mitigating actions may be taken in these situations, such as reducing injection rates and/or reducing injection pressures and/or injecting heated MEG and/or injecting heated $CO_2$ or other fluid, depending on what is being injected, into the subterranean void. The control commands may in any embodiment herein therefore further be configured to cause the system to perform any combination of these mitigating actions, for any or all of the at least two drill holes 140. The pre-set maximum pressure value, $P_{MAX}$, may be defined as a pre-set critical pressure limit, $P_{CRITICAL}$, at which the subterranean void 150 would be at risk of being damaged, minus a pre-set margin, m, giving the relationship: $P_{MAX}=(P_{CRITICAL}-m)$. The critical pressure limit, $P_{CRITICAL}$, is calculated based on the formation strength, in manners known in the art. The pre-set margin is selected such that there is sufficient time to reduce the pressure in the subterranean void 150 and stop the pressure from reaching the critical pressure limit, $P_{CRITICAL}$. Hence, the maximum pressure value, $P_{MAX}$, is defined such that it ensures that the formation is not damaged. The critical pressure limit, $P_{CRITICAL}$, may be the same for each of the at least two drill holes/wells 140, or it may differ locally around each drill hole 140 depending on local formation properties, in which case the pre-set maximum pressure value, $P_{MAX}$, is set to different values for each drill hole 140. The value of the pre-set margin may of course vary depending on circumstances. A suitable value may in some applications for example be around 50 barg or up to 90 barg above the formation pressure, e.g., typically in the interval from 50 barg to 90 barg above the formation pressure, including the end points. The formation pressure, as is well known in the art, is the pressure that is already existing in the subterranean void or reservoir before injection starts.

When the at least one choke valve in the valve system 121 is triggered to control the injection of fluid into the subterranean void 150 for a drill hole 140 in response to control commands $C_{cmd}$, there will inevitably be a delay before the fluid flow into the subterranean void 150 from the well 140 is reduced, because the at least one choke valve is located at the well head and thus controls the injection of fluid passing into the well 140. The system 200 may therefore comprise at least one additional choke valve (not shown in the figures), preferably at least one additional choke valve for each well 140, at or near the bottom opening 142 of the respective well 140, i.e., at or closely above the bottom opening 142 in the well 140 where fluid exits the well 140 and enters the subterranean reservoir 150 for long time storage. In these embodiments, the at least one additional choke valve of each drill hole 140 is configured to control the injection of fluid into the subterranean void 150 in response to control commands $C_{cmd}$ to avoid over pressurization or under pressurization in the subterranean reservoir 150. For this purpose, the at least one additional choke valve is configured to choke back to close off, or reduce, the flow of the fluid exiting the well 140 and entering the subterranean reservoir 150 in response to the control commands $C_{cmd}$. In other words, also these additional choke valves are controllable individually in response to the control commands and thereby further contribute to the improved injection flow control in the system, as described herein. The control site 160 is in these embodiments in turn configured to generate the control commands $C_{cmd}$ to also be configured to cause the at least one additional choke valve of each drill hole 140 to choke back if the current bottom pressure of the drill hole 140 is equal to or exceeds a pre-set maximum pressure value, $P_{MAX}$, and/or to control the injection of the fluid into the subterranean void 150 such that the current bottom pressure $P_{B_CURRENT}$ of the drill hole 140 does not deviate more than a first pre-set tolerance, T1, from the desired bottom pressure value, $P_{DES}$, or such that the rate of change, R, of the bottom pressure of the drill hole 140 over time does not exceed a second pre-set tolerance, T2. The at least one additional choke valve at or near the bottom opening 142 of each well 140 thereby provides a further safety solution that ensures faster reduction of fluid flow into the subterranean reservoir 150 in the case of an event that requires such a precaution, as described herein.

In some embodiments, the system 200 further comprises at least one additional pressure gauge (not shown in figures) for each drill hole 140 located at depths between the top opening 143 and the bottom opening 142 along the length of the well/drill hole 140. The at least one additional pressure gauge is/are located at different depths, preferably evenly distributed along the length, or depth, of the well/drill hole 140 and is/are configured to measure the pressure at the respective depth. In some non-limiting examples, additional pressure gauges may be located along the depth of the well at inter-distances of 50-200 meter, but any suitable number of additional pressure gauges and inter-distances may be selected depending on circumstances. Alternatively, or additionally, the system 200 may comprise at least one fibre-optic cable mounted, attached, or otherwise positioned/located between the top opening 143 and the bottom opening 142 along the length of the well/drill hole 140 and being configured to measure pressure and/or temperature. Measurements received from the at least one additional pressure gauge and/or fibre-optic cable may be used for predicting the behaviour of the fluid as it passes through the well/drill hole 140, using known relationships between pressure and other characteristics of the fluid, e.g., $CO_2$. Thereby, a better understanding of the dynamics in the reservoir, well/drill hole 140 and/or void 150 is obtained and the pressure control can be even further improved. The control commands $C_{cmd}$ may in these embodiments further be generated based on measurements received from the at least one additional pressure gauge and/or fibre-optic cable, or information derived from such measurements.

In one or more embodiment, the system may comprise at least one differential pressure sensor 125 for each drill hole 140 located at or near the choke valve, possibly in the well or drill hole 140, and being configured to measure pressure changes within the well or drill hole 140, wherein the control site 160 is configured to receive the measured pressure changes from the at least one differential pressure sensor 125 of each drill hole 140. The control site 160 is in these embodiments further configured to derive, from two or more received measured pressure changes, the rate of change, R, of the bottom pressure of each drill hole 140 over time.

In one embodiment of the invention, the system 200 further comprises a second pressure gauge 123, 123', 123" located at the top opening 143 of each drill hole 140 for measuring a top pressure, $P_T$, of the drill hole 140. For each drill hole 140, if a measured current bottom pressure, $P_B$, has not been received, the control site 160 is in this embodiment configured to, before generating the control commands $C_{cmd}$: receive a measured top pressure, $P_T$, from the second pressure gauge 123, 123', 123"; estimate a weight of the fluid column in the well or drill hole 140 based on the volume of the fluid column in the drill hole 140 and the density of the fluid in the drill hole 140; and estimate a current bottom pressure for the drill hole 140 based on the estimated weight of the fluid column and the received, measured, top pressure, $P_T$. It is noted that the density of the fluid in the drill hole 140 may be determined by detecting or measuring the density of the fluid directly or by detecting or measuring another parameter that may be processed to give information about the density of the fluid. One non-limiting example of such a parameter is a conductivity of the fluid that may be measured by a conductivity meter. Other non-limiting examples are presented in connection with embodiments herein.

Thereby, a back-up/safety solution is provided in the case that a measurement from the first pressure gauge 122 of any of the at least two drill holes 140 is not received, making the pressure control system 200 even more reliable. The control site 160 may in this embodiment be configured to set the value of the estimated current bottom pressure for each drill hole 140 as the current bottom pressure, $P_{B_CURRENT}$, for further use in generation of control commands.

The type of fluid is typically known. If the phase of the fluid and at least one temperature of the fluid in the drill hole 140 or well is also known, the control site 160 may be configured to obtain, i.e., receive or retrieve, reference values for the density of the fluid from a look up table or the like accessible to the system 200. If the temperature of the fluid at one or more height in the drill hole 140 or well is not known, the system 200 may comprise at least one temperature sensor 124 located in the well or drill hole 140 and configured to measure the temperature of the fluid in the well or drill hole 140, wherein the control site 160 is configured to receive the measured temperature from the at least one temperature sensor 124. The location of each of the at least one temperature sensor 124 may coincide with respective locations of the first pressure gauge 122, the second pressure gauge 123, 123', 123" and/or the at least one additional pressure gauge of a drill hole 140. Alternatively, or additionally, if the phase of the fluid is not known, the system 200 may comprise at least one density meter 126 located in each well or drill hole 140 and configured to identify a phase change and/or phase transition of the fluid within the well or drill hole 140, wherein the control site 160 is configured to receive density measurement(s) from at least one density meter 126 of each drill hole 140. The control site 160 may further be configured to derive information on a phase change and/or phase transition of the fluid within each well or drill hole 140 from the measurements of the at least one density meter 126 of the respective drill hole 140. The control site 160 may then be further configured to derive the current phase of the fluid in the well or drill hole 140 based on the received information on phase change and/or phase transition. For example, if there is an abrupt reduction in density or fluctuations in density (implying presence of both liquid and gaseous fluid), as can be seen from measurements performed over time, this indicates a phase transition. As another example, if the fluid is $CO_2$ and the temperature drops below the required temperature, typically close to 40 degrees, (and the pressure is around 39.8 barg) then the $CO_2$ fluid exits the supercritical state and enters the liquid phase, where there will be an equilibrium between gaseous and liquid $CO_2$. Gaseous $CO_2$ has a much lower density, and this will be detected as abrupt drops in density, and abrupt increases, indicating this happening. The control site 160 may hence be configured to determine that a phase transition of the fluid has taken place based on information such as that exemplified above. The location of each of the at least one density meter 126 may coincide with respective locations of the first pressure gauge 122, the second pressure gauge 123, 123', 123" and/or the at least one additional pressure gauge in each drill hole 140.

As an alternative to the estimations according to the different embodiments above, or in addition, the system 200 may in some embodiments comprise at least one density meter 126 for each drill hole 140 and the control site 160 may be configured to receive density measurements from at least one density meter 126 and estimate the weight of the fluid column in the well or drill hole 140 based on the volume of the fluid column in the drill hole 140 and the measured density value(s).

As in known in the art, the density of the fluid at the bottom of the well or drill hole 140 may also be derived in other ways, for example based on a known density at the top of the well or drill hole 140.

The volume of the fluid column in the well or drill hole 140 is typically equal to the inner volume of the well or drill hole 140, since the well or drill hole 140 will be filled with liquid phase fluid during injection operation. The inner volume of the well or drill hole 140, derived from the height of the well or drill hole 140 and the inner cross section area of the same, is known.

If the injection process is in the start-up or shut-down phase, if there has been an event in the well like e.g., damages to the reservoir and an abrupt pressure decrease, or if the well or drill hole 140 for some reason is not filled by fluid in liquid phase, the density of the fluid may vary over the column. The control site 160 may in these embodiments be configured to estimate the weight of the fluid column based on the measured top pressure, $P_T$, and a previously determined value for the bottom pressure, $P_B$. Alternatively, or additionally, control site 160 may in these embodiments be configured to receive density measurements from at least one density meter 126, determine the phase of the fluid at one or more heights within the well or drill hole 140 based on the density measurement(s) and estimate the weight of the fluid column based on this information. The control site 160 is further configured to determine the volume of the fluid column based on the estimated height of the fluid column and the known inner cross section area of the well or drill hole 140.

It is noted that if one of the inner diameter or inner cross-section area of the well or drill hole 140, or the flow rate is known, the other may be derived, as they are co-dependent variables.

Besides estimating a bottom pressure when a measurement is not received, a similar estimation of bottom pressure may also advantageously be used for verifying measurement of the first pressure gauge 122, to ensure that it is working as intended.

Measurements from the at least one temperature sensor 124 may further be used for monitoring the temperature and take mitigating actions if the temperature deviates more than a pre-set deviation from the desired temperature or changes faster than a pre-set allowed temperature rate of change. As mentioned herein, a temperature close to 40 degrees C. of the $CO_2$ is required for a successful injection process. This temperature must be monitored and mitigating measures must be taken if the temperatures along the well or drill hole 140 and into the subterranean void falls below the required temperature, which is pre-set and typically has a value close to 40 degrees C. Temperature differentials, i.e., variations in temperature (i.e. moving up and down over time) is the main problem that needs to be avoided, as these variations may damage the well, or more precisely the cement in the well and potentially even de-bond the cement. A period when the temperature needs to be especially carefully controlled is during start-up or shut-down, or during ramp-up of flow rate, when there will be Joule-Thompson effects and temperature variations, which may need to be compensated for by controlling the temperature, via the control site 160. A common problem is also temperature drop during start-up of the injection process. The control site 160 may for this purpose be configured to obtain information on the temperature of the fluid in the well or drill hole 140 and to generate control commands configured to cause the system 200 to use temperature affecting actuators to compensate for any temperature deviation that goes beyond the allowed pre-set allowed pre-set temperature thresholds or temperature variation thresholds.

In one or more embodiment, the fluid may be preheated before it is injected into the system 200, e.g., in the at least one fluid storage 115 from which the fluid is received.

As illustrated in FIG. 1, the control site, generically identified as 160, is adapted to generate the control commands $C_{cmd}$ for controlling the flow of fluid from the vessel 110 and down into the subterranean void 150. The control site 160 may be positioned at a location geographically separated from the offshore injection site 100, for example in a control room onshore. However, additionally or alternatively, the control site 160 may be positioned at an offshore location geographically separated from the offshore injection site, for example at another offshore injection site. Consequently, a single control site 160 can control multiple offshore injection sites 100. There is also large room for varying which control site 160 controls which offshore injection site 100. Communications and controls are thus located remote from the offshore injection site 100. Alternatively, or additionally, the control site 160 may located in the surface vessel or be integrated in the subsea template in the form of a local processor. The offshore injection site 100 may be powered locally, remotely, or both.

The offshore injection site 100 may include a buoy-based off-loading unit 170, for instance of submerged turret loading (STL) type. When inactive, the buoy-based off-loading unit 170 may be submerged to 30-50 meters depth, and when the vessel 110 approaches the offshore injection site 100 to offload fluid, the buoy-based off-loading unit 170 and at least one injection riser 171 and 172 connected thereto are elevated to the water surface 111. After that the vessel 110 has been positioned over the buoy-based off-loading unit 170, this unit is configured to be connected to the vessel 110 and receive the fluid from the vessel's fluid tank(s) 115, for example via a swivel assembly in the vessel 110.

Each of the at least one injection riser 171 and 172 respectively is configured to forward the fluid from the buoy-based off-loading unit 170 to the subsea template 120, which, in turn, is configured to pass the fluid on via the well head and the drill hole 140 down to the subterranean void 150.

The subsea template 120 may contain a power input interface 120*p*, which is implemented in at least one utility module and is configured to receive electric energy $P_E$ for operating the utility system. The power input interface 120*p* may be configured to receive the electric energy $P_E$ to be used in connection with operating a well at the well head.

FIG. 1*a* illustrates a generic power source 180, which is configured to supply the electric power $P_E$ to the power input interface 120*p*. It is generally advantageous if the electric power $P_E$ is supplied via a cable 185 from the power source 180 in the form of low-power direct current (DC) in the range of 200V-1000V, preferably around 400V. The power source 180 may either be co-located with the offshore injection site 100, for instance as a wind turbine, a solar panel and/or a wave energy converter; and/or be positioned at an onshore site and/or at another offshore site geographically separated from the offshore injection site 100. Thus, there is a good potential for flexibility and redundancy with respect to the energy supply for the offshore injection site 100.

In different embodiments, the valve system 121, as such, may be operated by hydraulic means, electric means or a combination thereof. The subsea template 120 preferably also includes at least one battery configured to store electric energy for use by the valve system as a backup to the electric energy $P_E$ received directly via the power input interface 120*p*. More precisely, if the valve system 121 is hydraulically operated, the subsea template 120 contains an HPU configured to supply pressurized hydraulic fluid for operation of the valve system 121. For example, the HPU may supply the pressurized hydraulic fluid through a hydraulic small-bore piping system. The at least one battery is here configured to store electric backup energy for use by the hydraulic power unit and the valve system 121.

At least one battery may be comprised in the utility module. Preferably, the power interface is configured to distribute the received electric power to the at least one battery. However, alternatively or in addition thereto, energy may be stored in the at least one battery refilling it/them with electrolytes or ammonia. Namely, the at least one battery may contain ammonia fuelled fuel cell with a subsea ammonia tank, where the ammonia is passively kept in liquid state by the hydrostatic pressure. Of course, an alternative to charge the battery is to replace a discharged battery with a charged ditto.

Alternatively, or additionally, the valve operations may also be operated using an electrical wiring system and electrically controlled valve actuators. In such a case, the subsea template 120 contains an electrical wiring system configured to operate the valve system 121 by means of electrical control signals. Here, the at least one battery is configured to store electric backup energy for use by the electrical wiring system and the valve system 121.

Consequently, the valve system 121 may be operated also if there is a temporary outage in the electric power supply to the offshore injection site. This, in turn, increases the overall reliability of the system 200.

In order to enable remote control from the control site 160, the subsea template 120 may contain a communication interface 120*c* that is communicatively connected to the control site 160. According to one embodiment of the invention, the communication interface 120*c* is implemented in the utility module. The communication interface 120*c* is also configured to receive the control commands $C_{cmd}$ via the communication interface 120*c*, and optionally further to return status signals $S_{stat}$ to the control site 160. The status signals $S_{stat}$ may be indicative of a status of the system 200, for example, but not limited to, if there is a failure of any of the system components.

Depending on the channel(s) used for forwarding the control commands $C_{cmd}$ between the control site 160 and the offshore injection site 100, the communication interface 120*c* may be configured to receive the control commands $C_{cmd}$ via a submerged fibre-optic and/or copper cable 165, a terrestrial radio link (not shown) and/or a satellite link (not shown). In the latter two cases, the communication interface 120*c* includes at least one antenna arranged above the water surface 111.

As described herein, the utility module may comprise at least one valve system, for example in the form of a valve tree, which is configured to forward the received fluid to each drill hole 140. Preferably, the at least one valve system or valve tree is configured to be remote controllable in response to the commands $C_{cmd}$ received via the communication interface 120*c*.

Embodiments of a method according to the invention will now be described in connection with FIGS. 3, 4 and 5.

Figure 3:
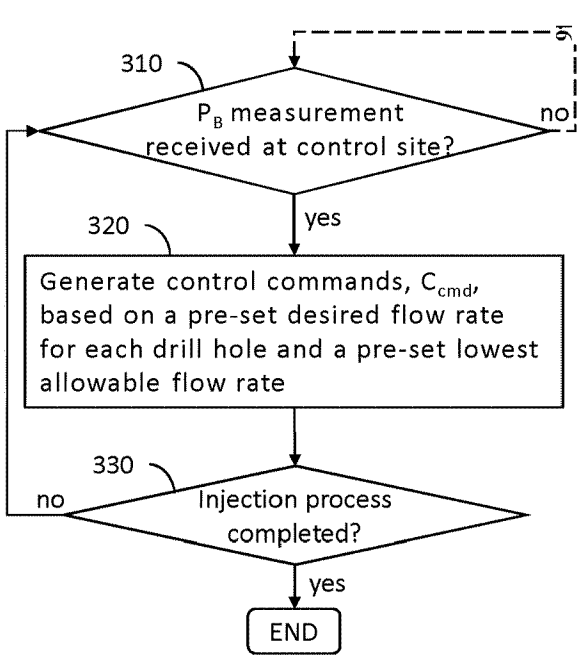
FIG. 3 is a flow diagram illustrating a method according to one embodiment of the invention.
Figure 5:
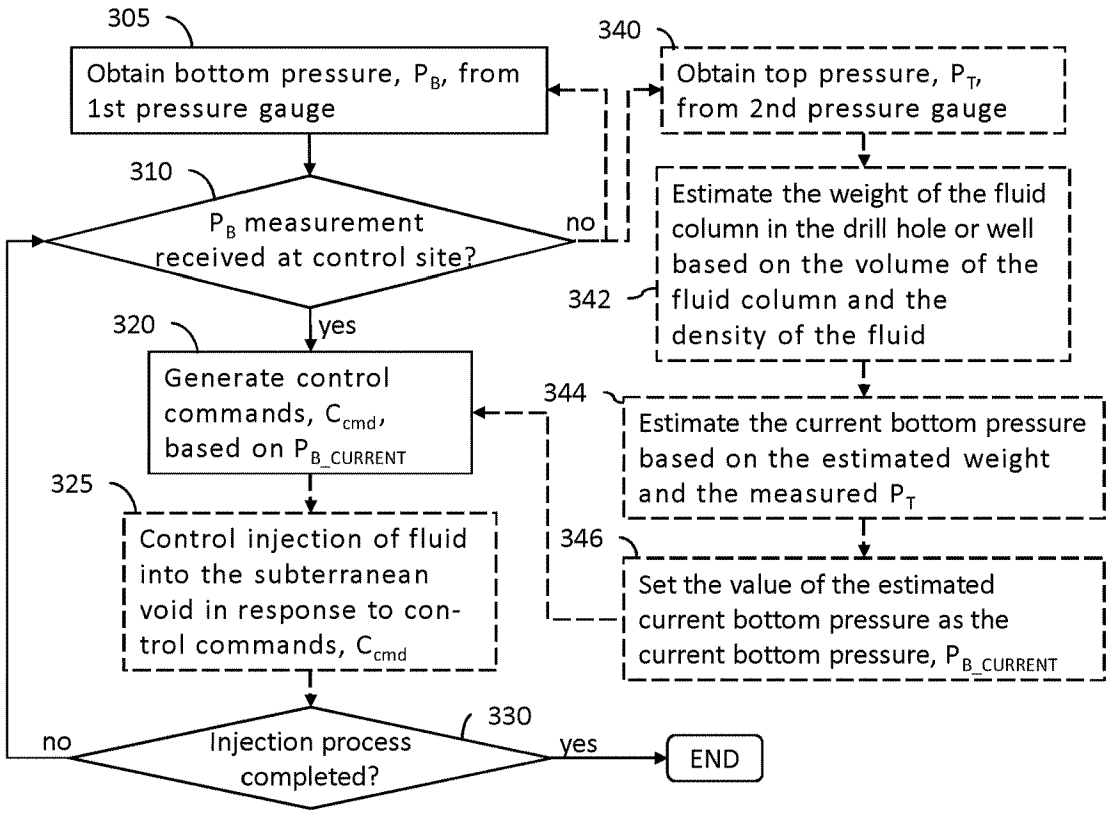
FIG. 5 is a flow diagram illustrating a method according to yet a further embodiment of the invention.
Figure 4:
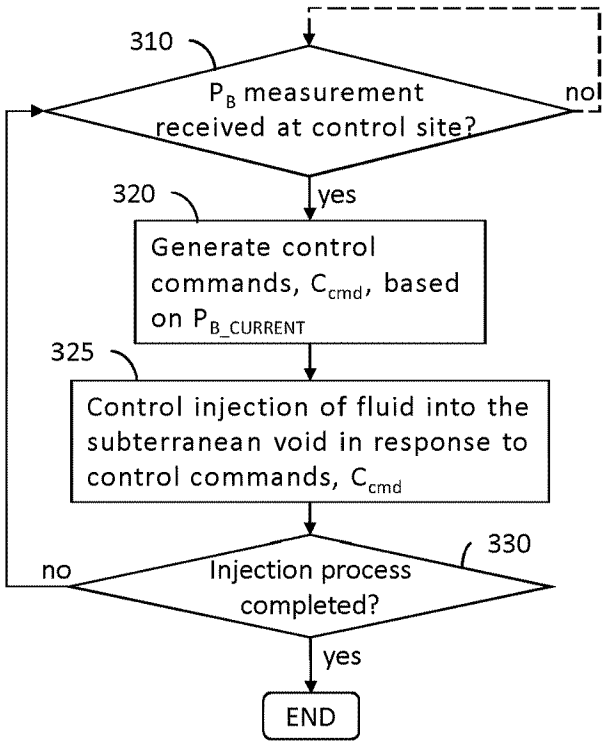
FIG. 4 is a flow diagram illustrating a method according to a further embodiment of the invention.

FIGS. 3, 4 and 5 are flow diagrams a method according to different embodiment of the invention for controlling the flow and injection pressure of fluid to be injected into a subterranean void 150 by a fluid handling system at an offshore injection site 100 for long term storage. The fluid handling system is the fluid handling system 200 described in connection with FIGS. 1 and 2. As described herein, the fluid handling system 200 comprises at least one subsea template 120 comprising a utility system with a valve system 121, the subsea template 120 being arranged on a seabed 130 in connection with at least two well heads for a respective at least two drill holes 140 to a subterranean void 150, wherein each drill hole 140 has a top opening 143 operatively connected to the respective well head and a bottom opening 142 arranged to pass fluid into the subterranean void 150, the system 200 further comprising a first pressure gauge 122 for each drill hole 140 located at the bottom opening 142 of the drill hole 140 for measuring a bottom pressure, $P_B$, of the drill hole 140.

Turning first to the embodiments illustrated in FIG. 3, the method comprises:

In step 310: for each of the at least two drill holes 140 checking, by the control site 160, if a measured bottom pressure, $P_B$, from the first pressure gauge 122 has been received at a control site 160 communicatively connected to the first pressure gauge 122 and the subsea template 120.

If a measured bottom pressure, $P_B$, has been received, setting the value of the measured bottom pressure, $P_B$, as the current bottom pressure, $P_{B_CURRENT}$, for the drill hole 140.

As indicated by the dashed arrow in FIG. 3, if a measured bottom pressure, $P_B$, has not been received the method may comprise repeating step 310 until a measured bottom pressure, $P_B$, has been received before the method continues in step 320.

In step 320: generating, by the control site 160, control commands $C_{cmd}$ based on the current bottom pressure, $P_{B_CURRENT}$, the control commands $C_{cmd}$ being configured to cause the at least one choke valve of each drill hole 140 to control the injection of the fluid into the subterranean void 150 via the respective drill hole 140 based on a pre-set desired flow rate for each respective drill hole 140 and a pre-set lowest allowable flow rate from the fluid storage.

The generated control commands $C_{cmd}$ may be configured to cause the at least one choke valve of each drill hole 140 to control the injection of the fluid into the subterranean void 150 such that the bottom pressure does not deviate more than a first pre-set tolerance, T1, from the desired bottom pressure value, $P_{DES}$, of the drill hole 140. Alternatively, or additionally, the generated control commands $C_{cmd}$ may be configured to cause the at least one choke valve to control the injection of the fluid into the subterranean void 150 such that the rate of change, R, of the bottom pressure of the drill hole 140 over time does not exceed a second pre-set tolerance, T2. Step 320 may in these embodiments comprise receiving measurements from at least one differential pressure sensor located at or near the choke valve of each drill hole 140 and being configured to measure pressure changes in the fluid to be injected or already present within the drill hole or well, and deriving the rate of change, R, of the bottom pressure of the drill hole 140 over time based on measurements over time received based on the measurement from the at least one differential pressure sensor 125. Alternatively, or additionally, step 320 may comprise deriving information on changes in density of the fluid comprised within the well or drill hole 140 based on measurements over time received from the at least one differential pressure sensor 125.

Advantageously, by controlling the injection of the fluid into the subterranean void 150 such that the bottom pressure does not deviate more than a first pre-set tolerance, T1, from the desired bottom pressure value the pressure is controlled to be within an allowed range which greatly reduces the risk of over or under pressurization and any potential damage that could be caused thereby. The first pre-set tolerance, T1, may be any suitable value depending on circumstances. Furthermore, by controlling the injection of the fluid into the subterranean void 150 such that the rate of change of the bottom pressure over time does not exceed a second pre-set tolerance, T2, greatly reduces the risk of potential damage to the subterranean void 150, the cap rock or the reservoir surrounding the subterranean void 150 and/or drill hole 140 due to fast pressure changes.

A combination of the two options, i.e. controlling the injection of the fluid into the subterranean void such that the bottom pressure does not deviate more than the first pre-set tolerance, T1, from the desired bottom pressure value and such that the rate of change of the bottom pressure over time does not exceed the second pre-set tolerance, T2, suitably provides even further reduced risk of damage to the subterranean void 150, the cap rock or the reservoir surrounding the subterranean void 150 and/or drill hole 140.

In one or more embodiment, step 320 may comprise generating the control commands ($C_{cmd}$), by the control site (160), such that the generated control commands $C_{cmd}$ are further configured to cause the at least one choke valve of each drill hole 140 to control the injection of the fluid into the subterranean void 150 via the drill hole 140 such that the at least one choke valve to choke back if the current bottom pressure is equal to or exceeds a pre-set maximum pressure value, $P_{MAX}$.

In one or more embodiment, wherein the system 200 comprises at least one additional pressure gauge and/or at least one fibre optic cable for each drill hole 140, as described herein, step 320 may comprise generating the control commands $C_{cmd}$ also based on pressure measurements received from the at least one additional pressure gauge and/or fibre optic cable, or information derived from such measurements.

As described herein, the system 200 may comprise at least one additional choke valve, preferably at least one additional choke valve for each well 140, at or near the bottom opening 142 of the well 140. In these embodiments step 320 of generating, by the control site 160, control commands $C_{cmd}$ based on the current bottom pressure, $P_{B_CURRENT}$, may further comprise generating the control commands $C_{cmd}$ to be configured to cause the at least one additional choke valve of each drill hole 140 to control the injection of the fluid into the subterranean void 150 to avoid over pressurization or under pressurization in the subterranean reservoir 150. This may include generating the control commands $C_{cmd}$ to also be configured to cause the at least one additional choke valve of each drill hole 140 to choke back if the current bottom pressure is equal to or exceeds a pre-set maximum pressure value, $P_{MAX}$, and/or to control the injection of the fluid into the subterranean void 150 via the drill hole 140 such that the current bottom pressure $P_{B_CURRENT}$ of the drill hole 140 does not deviate more than a first pre-set tolerance, T1, from the desired bottom pressure value, $P_{DES}$, or such that the rate of change, R, of the bottom pressure of the drill hole 140 over time does not exceed a second pre-set tolerance, T2.

Suitably, by performing flow and injection rate control according to any embodiment of step 320 simultaneously for at least two drill holes 140 injecting fluid into the same subterranean void 150 and controlling the flow of the at least two drill holes 140 individually, the control is even further improved and the risk of over or under pressurization and any potential damage that could be caused thereby is even further reduced.

In step 330: checking, by the control site 160, if the injection process has been completed.

If the injection process has been completed, the method ends. If the injection process has not been completed, the method returns to step 310.

In other words, steps 310 to 350 are performed repeatedly during the injection process. Thereby, any unwanted and potentially dangerous deviation in pressure is detected at an early stage, enabling an improved regulation of pressure in the subterranean void and consequently a greatly reduced risk of damage to the subterranean void.

As shown in the embodiments of FIG. 4, and also as an optional feature in the embodiments of FIG. 5, the method may further comprise:

In step 325: controlling injection of fluid into the subterranean void in response to the received control commands $C_{cmd}$, using the at least one choke valve of each drill hole 140.

Optionally, step 325 may also comprise controlling injection of fluid into the subterranean void in response to the received control commands $C_{cmd}$, using the at least one additional choke valve of each drill hole 140.

Controlling injection of fluid using the at least one choke valve according to step 325 may also be expressed as controlling the utility system to operate the valve system 121, particularly the at least one choke valve of each drill hole 140, in response to the received control commands $C_{cmd}$. The utility system is in these embodiments configured to operate the valve system 121, particularly the at least one choke valve of each drill hole 140, in response to the received control commands $C_{cmd}$.

Step 325 is performed before the step of checking of the injection process has been completed and is hence part of the loop of steps 310 to 330. Thereby, any unwanted and potentially dangerous deviation that is detected using embodiments of the invention are also remedied at an early stage. Consequently, the risk of damage to the subterranean void is greatly reduced.

The above-described method improves the control and safety of the injection process. If the value of the bottom pressure, $P_B$, of any of the at least two drill holes 140 is for some reason not measured, or not received, at one point in time the method comprises as mentioned in step 310 the option of performing repeated measurements by the first pressure gauge 122 of the drill hole 140 and repeatedly checking for such a measurement value being received at the control site 160. However, if the problem is persistent, e.g., if the first pressure gauge 122 is malfunctioning, an alternative manner of obtaining the current bottom pressure, $P_{B_CURRENT}$, for the drill hole 140 may be needed as a further safety back-up solution.

Such a back-up solution, according to one or more embodiment of the method, is shown in FIG. 5.

In addition to the steps described in connection with FIGS. 3 and 4, the method of FIG. 5 further includes steps 340 to 346 to be performed before generating the control commands $C_{cmd}$, if a measured value for the bottom pressure, $P_B$, has not been received from the first pressure gauge 122 of a drill hole 140, the steps comprising:

In step 340: receiving a top pressure, $P_T$, measured by a second pressure gauge 123, 123', 123" of the drill hole 140 located at the top opening 143 of the drill hole 140, at the control site 160;

The wording that the second pressure gauge 123, 123', 123" is located at the top opening 143 of the drill hole 140 includes locations at or near the top of the top opening 143 of the drill hole 140, such as at a high location inside the drill hole 140, e.g., within a pre-set tolerance from the top opening 143, at the injection well head or near distribution manifolds.

In step 342: estimating, by the control site 160, a weight of the fluid column in the drill hole 140 based on the volume of the fluid column in the drill hole 140 and the density of the fluid in the drill hole 140.

The type of fluid is typically known.

If the phase of the fluid and at least one temperature of the fluid in the drill hole 140 or well is also known, step 342 may further comprise obtaining, by receiving or retrieving at the control site 160, reference values for the density of the fluid from a look up table or the like accessible to the system 200.

If the phase of the fluid is not known, step 342 may further comprise receiving, by the control site 160, measured density value(s) from at least one density meter 126 in the drill hole 140 and derive information on a phase change and/or phase transition of the fluid within the well or drill hole 140 based on the measurements of the at least one density meter 126. The method may in these embodiments further comprise deriving the current phase of the fluid in the well or drill hole 140 based on the received information on phase change and/or phase transition, as further described for the system 200 in connection with FIG. 2. Alternatively, to obtain information on the phase of the fluid in the well or drill hole 140 at the control site 160, step 342 may comprise retrieving stored information on the phase of the fluid in the well or drill hole 140 from a memory (not shown in the figures) communicatively connected to the control site 160. In this case, the stored information must be recently stored and continuously updated, for example based on repeated measurements received from the at least one density meter 126, to make sure that the information is kept relevant.

Alternatively, or additionally, if the temperature of the fluid at one or more height in the drill hole 140 or well is not known, step 342 may further comprise receiving, by the control site 160, measured temperature value(s) from the at least one temperature sensor 124 in the drill hole 140. The at least one temperature sensor 124 may be in the form of separate sensor units or in the form of a continuous fibre-optic cable or the like located along the well/drill hole and being configured to measure pressure and/or temperature. Each of the at least one fibre-optical cable may advantageously be used for measuring both pressure and temperature. The fibre-optic cable may therefore be the same fibre-optic cable as described herein with regard to pressure measurements. Alternatively, to obtain information on the temperature of the fluid in the well or drill hole 140 at the control site 160 step 342 may comprise retrieving stored information on the temperature of the fluid in the well or drill hole 140 from a memory. As in the case of stored fluid phase information, the stored temperature information must also be recently stored and continuously updated, for example repeated measurements received from the at least one temperature sensor 124, to make sure that the information is kept relevant.

As an alternative to the estimations according to the different embodiments above, or in addition, step 342 may comprise receiving density measurements from at least one density meter 126 in the drill hole 140; and estimating the weight of the fluid column in the well or drill hole 140 based on the volume of the fluid column in the well or drill hole 140 and the receiving density measurement value(s).

As mentioned herein, the volume of the fluid column in the well or drill hole 140 is typically equal to the inner volume of the well or drill hole 140, which is known. However, if the injection process is in the start-up or shut-down phase, if there has been an event in the well like e.g., damages to the reservoir and an abrupt pressure decrease, or if the well or drill hole 140 for some other reason is not filled by fluid, the density of the fluid may vary over the column. Step 342 may in these embodiments comprise estimating the weight of the fluid column based on the measured top pressure, $P_T$, and a previously determined value for the bottom pressure, $P_B$. The previously recorded value for the bottom pressure $P_B$ may be the value of a previously set current bottom pressure, $P_{B_CURRENT}$, the latest value of a bottom pressure $P_B$ received from the first pressure gauge 122, or a current bottom pressure, $P_{B_CURRENT}$, value previously estimated according to steps 340 to 348. Alternatively, or additionally, step 342 may in these embodiments comprise receiving density measurements from at least one density meter 126; determining the phase of the fluid at one or more height within the well or drill hole 140 based on the density measurement(s); and estimate the weight of the fluid column based on this information. In these embodiments, step 342 further comprises determining the volume of the fluid column based on the estimated weight of the fluid column and the known inner cross section area of the well or drill hole 140.

In step 344: estimating, by the control site 160, a current bottom pressure for the drill hole 140 based on the estimated weight of the fluid column and the measured top pressure $P_T$.

Thereby, a back-up/safety solution is provided in the case that a measurement from the first pressure gauge 122 is not received, making the pressure control method even more reliable.

Besides estimating a bottom pressure when a measurement is not received, the estimation may also advantageously be used for verifying measurement of the first pressure gauge 122, to ensure that it is working as intended. The method may in these embodiments further comprise verifying the measurement of the first pressure gauge 122 based on the estimated bottom pressure.

In step 346: setting, by the control site 160, the value of the estimated current bottom pressure as the current bottom pressure, $P_{B_CURRENT}$, for the drill hole 140.

Thereby, an alternative way of obtaining a sufficiently accurate value for the current bottom pressure, $P_{B_CURRENT}$, as a basis for generating the control commands $C_{cmd}$ in step 320 and controlling the injection of fluid, is provided. Advantageously, this means that the injection process need not be delayed, and the safety need not be compromised if a measurement of the bottom pressure, $P_B$, of any or all of the at least two drill holes 140 is for some reason not available.

In one or more embodiments, the method may further comprise obtaining, by the control site 160, information on the temperature of the fluid in the well or drill hole 140 from at least one temperature sensor in each drill hole 140 and generating control commands configured to cause the system 200 to use temperature affecting actuators to compensate for any temperature deviation that goes beyond one or more allowed pre-set temperature thresholds or temperature variation thresholds. The method may comprise preheating the before it is injected into the system 200, e.g., in the at least one fluid storage 115 from which the fluid is received.

Variations to the disclosed embodiments can be understood and effected by those skilled in the art in practicing the claimed invention, from a study of the drawings, the disclosure, and the appended claims.

In one or more embodiment, there is provided a non-transitory computer-readable storage medium storing instructions which, when executed by processing circuitry 210 of the fluid handling system 200, cause the system 200 to perform the method as defined in any of the method embodiments disclosed herein (in other words, in the claims, the summary, or the detailed description). The fluid handling system 200 is the fluid handling system 200 described in connection with FIGS. 1*a*, 1*b*, 2, 6*a* and 6*b*. The processing circuitry 210 may be comprised in the control site 160, as illustrated in FIG. 2.

The non-transitory computer-readable storage medium may store instructions which, when executed by the processing circuitry 210 of the fluid handling system 200, cause the system 200 to, repeatedly, for each of the at least two drill holes (140): check if a measured bottom pressure, $P_B$, from the first pressure gauge 122 of the system 200 has been received at a control site 160 communicatively connected to the first pressure gauge 122 and the subsea template 120 comprised in the system 200; and, if a measured bottom pressure, $P_B$, has been received, setting the value of the measured bottom pressure, $P_B$, as the current bottom pressure of the drill hole. The non-transitory computer-readable storage medium may further store instructions which, when executed by the processing circuitry 210 of the fluid handling system 200, cause the system 200 to generate control commands $C_{cmd}$, by the control site 160, configured to cause the at least one choke valve of each drill hole 140 to control the injection of the fluid into the subterranean void 150 based on a pre-set desired flow rate for each drill hole 140 and a pre-set lowest allowable flow rate from the fluid storage. In one or more embodiment, the control commands $C_{cmd}$ may be configured to cause the at least one choke valve of each drill hole 140 to control the injection of the fluid into the subterranean void 150 such that the bottom pressure does not deviate more than a first pre-set tolerance, T1, from the desired bottom pressure value, $P_{DES}$, and/or such that the rate of change, R, of the bottom pressure over time does not exceed a second pre-set tolerance, T2. The control commands $C_{cmd}$ may further be configured to cause the at least one choke valve of each drill hole to choke back if the current bottom pressure is equal to or exceeds a pre-set maximum pressure value, $P_{MAX}$.

The non-transitory computer-readable storage medium may further store instructions which, when executed by processing circuitry 210 of the system 200, cause the system 200 to, before generating the control commands $C_{cmd}$, if a measured value for the current bottom pressure, PB, has not been received, for each drill hole 140: receive a top pressure, $P_T$, at the control site 160, wherein the top pressure, $P_T$, is measured by a second pressure gauge 123 comprised in the system 200 and located at the top opening 143 of the drill hole 140; estimate, by the control site 160, a weight of the fluid column in the drill hole 140 based on the volume of the fluid column in the drill hole 140 and the density of the fluid in the drill hole 140; estimate, by the control site 160, a current bottom pressure based on the estimated weight of the fluid column and the received top pressure, $P_T$; and setting the value of the estimated current bottom pressure as the current bottom pressure, $P_{B_CURRENT}$, of the drill hole 140.

In one or more embodiments, the non-transitory computer-readable storage medium may further store instructions which, when executed by processing circuitry 210 of the system 200, cause the system 200 to perform the steps or functions according to any of the method embodiments described herein.

The non-transitory computer-readable storage medium may for example be provided in a computer program product. In other words, a computer program product may for example comprise a non-transitory computer-readable storage medium storing instructions which, when executed by the processing circuitry 210 of the system 200, cause the system 200 to perform the method as defined in any of the method embodiments.

The storage medium may, but need not necessarily, be comprised in the system 200.

It will be appreciated that the processing circuitry (or a processor) may comprise a combination of one or more of a microprocessor, controller, microcontroller, central processing unit, digital signal processor, application-specific integrated circuit, field programmable gate array, or any other suitable computing device, resource, or combination of hardware, software and/or encoded logic operable to provide computer functionality, either alone or in conjunction with other computer components (such as a memory or storage medium).

It will also be appreciated that a memory or storage medium (or a computer-readable medium) may comprise any form of volatile or non-volatile computer readable memory including, without limitation, persistent storage, solid-state memory, remotely mounted memory, magnetic media, optical media, random access memory (RAM), read-only memory (ROM), mass storage media (for example, a hard disk), removable storage media (for example, a flash drive, a Compact Disk (CD) or a Digital Video Disk (DVD)), and/or any other volatile or non-volatile, non-transitory device readable and/or computer-executable memory devices that store information, data, and/or instructions that may be used by a processor or processing circuitry.

The term "comprises/comprising" when used in this specification is taken to specify the presence of stated features, integers, steps, or components. The term does not preclude the presence or addition of one or more additional elements, features, integers, steps or components or groups thereof. The indefinite article "a" or "an" does not exclude a plurality. In the claims, the word "or" is not to be interpreted as an exclusive or (sometimes referred to as "XOR"). On the contrary, expressions such as "A or B" covers all the cases "A and not B", "B and not A" and "A and B", unless otherwise indicated. The mere fact that certain measures are recited in mutually different dependent claims does not indicate that a combination of these measures cannot be used to advantage. Any reference signs in the claims should not be construed as limiting the scope.

It is also to be noted that features from the various embodiments described herein may freely be combined, unless it is explicitly stated that such a combination would be unsuitable.

The invention is not restricted to the described embodiments in the figures but may be varied freely within the scope of the claims.

The invention claimed is:

1. A fluid handling system for controlling a flow and an injection pressure of fluid to be injected into a subterranean void at an offshore injection site for long term storage, the fluid handling system comprising:

a subsea template arranged on a seabed in connection with at least two well heads for a respective at least two drill holes to a subterranean void, wherein each drill hole has a top opening operatively connected to the respective well head and a bottom opening arranged to pass fluid into the subterranean void, wherein the subsea template is configured to receive fluid from a fluid storage, the subsea template comprising a utility system configured to cause received fluid to be injected into the subterranean void via the at least two drill holes, wherein the subsea template is in fluid connection with each of the well heads of the at least two drill holes via a respective separate conduit or via a distribution manifold;

wherein the utility system comprises a valve system with at least one choke valve for each drill hole configured to control the injection of fluid into the subterranean void in response to control commands ($C_{cmd}$);

a first pressure gauge in each of the at least two drill holes, the first pressure gauge being located at the bottom opening of the drill hole for measuring a bottom pressure, $P_B$ of the drill hole; and a control site being communicatively connected to the first pressure gauge of each of the at least two drill holes and to the subsea template, wherein the control site is configured to, repeatedly:

for each of the at least two drill holes check if a measured bottom pressure, $P_B$, has been received from the first pressure gauge; and if a measured bottom pressure, $P_B$, has been received set the value of the measured bottom pressure, $P_B$, as the current bottom pressure for the drill hole; and generate control commands ($C_{cmd}$) configured to cause the at least one choke valve of each drill hole to control the injection of the fluid into the subterranean void via the respective drill hole based on a respective pre-set desired flow rate for each drill hole and a pre-set lowest allowable flow rate.

2. The system according to claim 1, wherein the control site is configured to generate the control commands ($C_{cmd}$) to be configured to cause the at least one choke valve of each drill hole to control the injection of the fluid into the subterranean void via said drill hole such that the bottom pressure of the drill hole does not deviate more than a first pre-set tolerance, T1, from the desired bottom pressure value, $P_{DES}$, or such that the rate of change, R, of the bottom pressure over time does not exceed a second pre-set tolerance, T2.

3. The system according to claim 1, wherein the control site is configured to generate the control commands ($C_{cmd}$) such that the control commands ($C_{cmd}$) are further configured to cause the at least one choke valve of each drill hole to choke back if the current bottom pressure of the drill hole is equal to or exceeds a pre-set maximum pressure value, $P_{MAX}$.

4. The system according to claim 1, further comprising a second pressure gauge located at the top opening of each drill hole for measuring a top pressure, $P_T$, of the drill hole, wherein, for each drill hole:

if a measured current bottom pressure, $P_B$, has not been received for the drill hole, the control site is further configured to, before generating the control commands ($C_{cmd}$):

receive a measured top pressure, $P_T$, for the drill hole from the second pressure gauge;

estimate a weight of the fluid column in the drill hole based on the volume of the fluid column in the drill hole and the density of the fluid in the drill hole; and estimate a current bottom pressure for the drill hole based on the estimated weight of the fluid column and the received top pressure, $P_T$.

5. The system according to claim 1, further comprising a selection of:

at least one temperature sensor for each drill hole, configured to measure the temperature of the fluid in the drill hole, wherein the control site is configured to receive the measured temperature from the at least one temperature sensor;

at least one differential pressure sensor for each drill hole, configured to measure pressure changes within the drill hole, wherein the control site is configured to receive the measured pressure changes from the at least one differential pressure sensor; and/or at least one density meter for each drill hole, configured to identify a phase change and/or phase transition of the fluid within the drill hole, wherein the control site is configured to receive information on a phase change and/or phase transition of the fluid within the drill hole from the at least one density meter.

6. The system according to claim 1, wherein the control site is located in a surface vessel.

7. The system according to claim 1, wherein the control site is an onshore control site.

8. The system according to claim 1, wherein the control site is integrated in the subsea template in the form of a local processor.

9. The system according to claim 1, wherein the valve system is a valve tree.

10. The system according to claim 1, wherein the fluid comprises carbon dioxide, $CO_2$.

11. The system according to claim 3, wherein the pre-set maximum pressure value, $P_{MAX}$, is defined as a pre-set critical pressure limit, $P_{CRITICAL}$, at which the subterranean void would be at risk of being damaged, minus a pre-set margin, m: $P_{MAX}=(P_{CRITICAL}-m)$.

12. The system according to claim 1, further comprising at least one additional pressure gauge for each drill hole, located at one or more depth between the top opening and the bottom opening along the drill hole and being configured to measure the pressure at the respective depth.

13. The system according to claim 1 further comprising at least one additional choke valve for each drill hole, at or near the bottom opening of the drill hole, wherein the at least one additional choke valve is configured to control the injection of fluid into the subterranean void in response to control commands $C_{cmd}$.

14. A method for controlling a flow and an injection pressure of fluid to be injected into a subterranean void by a fluid handling system at an offshore injection site for long term storage, wherein the fluid handling system comprises a subsea template comprising a utility system with a valve system, wherein the subsea template is configured to receive fluid from a fluid storage and is arranged on a seabed in connection with at least two well heads for respective at least two drill holes to a subterranean void, wherein the subsea template is in fluid connection with each of the well heads of the at least two drill holes via a respective separate conduit or via a distribution manifold, wherein each drill hole has a top opening operatively connected to the well head and a bottom opening arranged to pass fluid into the subterranean void, the system further comprising a first pressure gauge for each drill hole, located at the bottom opening of the drill hole for measuring a bottom pressure, $P_B$ of the drill hole, wherein the method comprises, repeatedly:

for each of the at least two drill holes:

checking, by a control site, if a measured bottom pressure, $P_B$, from the first pressure gauge has been received at the control site communicatively connected to the first pressure gauge and the subsea template; and if a measured bottom pressure, $P_B$, has been received, setting, by the control site, the value of the measured bottom pressure, $P_B$, as the current bottom pressure for the drill hole; and generating control commands ($C_{cmd}$), by the control site, configured to cause at least one choke valve of each drill hole to control the injection of the fluid into the subterranean void via the respective drill hole based on a respective pre-set desired flow rate for each drill hole and a pre-set lowest allowable flow rate from the fluid storage.

15. The method according to claim 14, wherein generating the control commands ($C_{cmd}$), by the control site, comprises generating the control commands ($C_{cmd}$) to be configured to cause the at least one choke valve of each drill hole to control the injection of the fluid into the subterranean void such that the bottom pressure of the drill hole does not deviate more than a first pre-set tolerance, T1, from the desired bottom pressure value, $P_{DES}$, or such that the rate of change, R, of the bottom pressure of the drill hole over time does not exceed a second pre-set tolerance, T2.

16. The method according to claim 14, wherein generating the control commands ($C_{cmd}$), by the control site, comprises generating the control commands ($C_{cmd}$) to further be configured to cause the at least one choke valve of each drill hole to choke back if the current bottom pressure of the drill hole is equal to or exceeds a pre-set maximum pressure value PMAX.

17. The method according to claim 14, further comprising, before generating the control commands ($C_{cmd}$), if a measured value for the current bottom pressure, $P_B$, has not been received:

for each drill hole:

receiving a top pressure, $P_T$, measured by a second pressure gauge located at the top opening of the drill hole;

estimating, by the control site, a weight of the fluid column in the drill hole based on the volume of the fluid column in the drill hole and the density of the fluid in the drill hole;

estimating, by the control site, a current bottom pressure based on the estimated weight of the fluid column and the received top pressure, $P_T$; and setting, by the control site, the value of the estimated current bottom pressure as the current bottom pressure, $P_{B_CURRENT}$, of the drill hole.

18. The method according to claim 14, further comprising receiving measurements at the control site for each drill hole from at least one of a temperature sensor configured to measure the temperature of the fluid in the drill hole, a differential pressure sensor configured to measure pressure changes within the drill hole and/or a density meter configured to identify a phase change and/or phase transition of the fluid within the drill hole, and estimating, by the control site, the current bottom pressure based on the received measurements.

19. The method according to claim 14, wherein the fluid comprises carbon dioxide, $CO_2$.

20. The method according to claim 16, wherein the pre-set maximum pressure value, PMAX, is defined as a pre-set critical pressure limit, $P_{CRITICAL}$, at which the subterranean void would be at risk of being damaged, minus a pre-set margin, m: $P_{MAX}=(P_{CRITICAL}-m)$.

21. The method according to claim 14, wherein generating, by the control site, control commands $C_{cmd}$ based on the current bottom pressure, $P_{B_CURRENT}$, further comprises generating the control commands $C_{cmd}$ to be configured to cause at least one additional choke valve at or near the bottom opening of each drill hole to control the injection of fluid into the subterranean void.

22. A non-transitory computer-readable storage medium storing instructions for a fluid handling system, the system comprising a subsea template including a utility system with a valve system, wherein the subsea template is configured to receive fluid from a fluid storage and is arranged on a seabed in connection with at least two well heads for respective at least two drill holes to a subterranean void, wherein the subsea template is in fluid connection with each of the well heads of the at least two drill holes via a respective separate conduit or via a distribution manifold, wherein each drill hole has a top opening operatively connected to the well head and a bottom opening arranged to pass fluid into the subterranean void, the system further comprising a first pressure gauge for each drill hole, located at the bottom opening of the drill hole for measuring a bottom pressure, $P_B$ of the drill hole, which instructions, when executed by processing circuitry of the fluid handling system, cause the system to, repeatedly:

for each of the at least two drill holes:

check if a measured bottom pressure, $P_B$, from the first pressure gauge has been received at a control site communicatively connected to the first pressure gauge and the subsea template; and if a measured bottom pressure, $P_B$, has been received, set the value of the measured bottom pressure, $P_B$, as the current bottom pressure for the drill hole; and generate control commands ($C_{cmd}$), by the control site, configured to cause the at least one choke valve of each drill hole to control the injection of the fluid into the subterranean void based on a pre-set desired flow rate for each drill hole and a pre-set lowest allowable flow rate from the fluid storage.

23. The non-transitory computer-readable storage medium of claim 22 further storing instructions which, when executed by the processing circuitry of the system, cause the system to generate the control commands ($C_{cmd}$) to be configured to cause the at least one choke valve of each drill hole to control the injection of the fluid into the subterranean void such that the bottom pressure does not deviate more than a first pre-set tolerance, T1, from the desired bottom pressure value, $P_{DES}$, or such that the rate of change, R, of the bottom pressure over time does not exceed a second pre-set tolerance, T2.

24. The non-transitory computer-readable storage medium of claim 22 further storing instructions which, when executed by processing circuitry of the system, cause the system to cause the at least one choke valve of each drill hole to choke back if the current bottom pressure is equal to or exceeds a pre-set maximum pressure value, $P_{MAX}$.

25. The non-transitory computer-readable storage medium of claim 22 further storing instructions which, when executed by processing circuitry of the system, cause the system to, before generating the control commands ($C_{cmd}$), if a measured value for the current bottom pressure, $P_B$, has not been received:

for each drill hole:

receive a top pressure, $P_T$, at the control site, wherein the top pressure, $P_T$, is measured by a second pressure gauge comprised in the system and located at the top opening of the drill hole;

estimate, by the control site, a weight of the fluid column in the drill hole based on the volume of the fluid column in the drill hole and the density of the fluid in the drill hole;

estimate, by the control site, a current bottom pressure based on the estimated weight of the fluid column and the received top pressure, $P_T$; and setting the value of the estimated current bottom pressure as the current bottom pressure, $P_{B_CURRENT}$, of the drill hole.

* * * * *